US011118789B2

(12) United States Patent
Martino et al.

(10) Patent No.: US 11,118,789 B2
(45) Date of Patent: Sep. 14, 2021

(54) MONITOR FOR A NATURAL GAS-FIRED APPLIANCE

(71) Applicant: MARTINO CONTRACTORS LTD., Concord (CA)

(72) Inventors: Michael Martino, Concord (CA); Ricardo Dias Barbosa, Concord (CA); Georges Livanos, Toronto (CA)

(73) Assignee: MARTINO CONTRACTORS LTD., Concord (CA)

( * ) Notice: Subject to any disclaimer, the term of this patent is extended or adjusted under 35 U.S.C. 154(b) by 0 days.

(21) Appl. No.: 15/129,177

(22) PCT Filed: Mar. 26, 2015

(86) PCT No.: PCT/CA2015/000185
§ 371 (c)(1),
(2) Date: Sep. 26, 2016

(87) PCT Pub. No.: WO2015/143543
PCT Pub. Date: Oct. 1, 2015

(65) Prior Publication Data

US 2017/0115010 A1 Apr. 27, 2017

(30) Foreign Application Priority Data

Mar. 26, 2014 (WO) ..... PCT/CA2014/000287

(51) Int. Cl.
*F24D 19/10* (2006.01)
*F24H 9/20* (2006.01)
(Continued)

(52) U.S. Cl.
CPC ..... *F24D 19/10* (2013.01); *F23N 5/24* (2013.01); *F23N 5/242* (2013.01); *F24C 3/12* (2013.01);
(Continued)

(58) Field of Classification Search
CPC combination set(s) only.
See application file for complete search history.

(56) References Cited

U.S. PATENT DOCUMENTS 5,377,529 A * 1/1995 Boyd ..... G01M 3/2807 340/605
6,059,195 A 5/2000 Adams et al.
(Continued)

FOREIGN PATENT DOCUMENTS

EP 1479984 A1 11/2004
GB 2414535 A * 11/2005 ..... F23N 5/242
(Continued)

OTHER PUBLICATIONS

JP2009133523MT; machine translation of JP2009133523, previously cited and provided by Applicant.*
(Continued)

*Primary Examiner* — Steven B McAllister
*Assistant Examiner* — Elizabeth M. May
(74) *Attorney, Agent, or Firm* — Perry + Currier

(57) ABSTRACT

A monitor for a natural gas-fired appliance is provided. The monitor comprises: a natural gas cycle-monitor interface configured to receive cycling signals from one or more of: the appliance; and a monitoring device located in the appliance and/or proximal to the appliance; a processor, in communication with the interface, configured to monitor cycles of the appliance based on the cycling signals; one or more indicators, in communication with the processor, configured to provide an alarm when the processor determines that the cycles of the appliance meets a threshold value; a first reset device configured to temporarily reset the one or more indicators to turn off the alarm when actuated, the one or more indicators again providing the alarm after a given time period following a temporary reset; and, a second reset
(Continued)

device configured to reset monitoring of the cycles at the processor when actuated.

9 Claims, 19 Drawing Sheets

(51) Int. Cl.
*F24C 3/12* (2006.01)
*F23N 5/24* (2006.01)

(52) U.S. Cl.
CPC ..... *F24H 9/2085* (2013.01); *F24D 19/1084* (2013.01)

(56) References Cited

U.S. PATENT DOCUMENTS

| | | | | |
|---|---|---|---|---|
| 6,728,600 | B1 | 4/2004 | Contaldo et al. | |
| 8,069,013 | B2 * | 11/2011 | Hotton | G03G 15/556 165/11.1 |
| 8,715,587 | B1 | 5/2014 | Downs | |
| 2009/0014634 | A1 * | 1/2009 | Sikora | G01M 11/3145 250/227.14 |
| 2010/0201531 | A1 * | 8/2010 | Pakravan | G08B 29/20 340/632 |
| 2011/0284777 | A1 * | 11/2011 | Pitchford | F16K 31/086 251/65 |
| 2013/0153035 | A1 * | 6/2013 | Young | F23N 1/005 137/1 |
| 2013/0153798 | A1 | 6/2013 | Kucera et al. | |

FOREIGN PATENT DOCUMENTS

| | | | |
|---|---|---|---|
| GB | 2414535 | A | 11/2005 |
| JP | 2009133523 | A | 6/2009 |

OTHER PUBLICATIONS

International Search Report for "A Monitor for a Natural Gas-Fired Appliance", PCT/CA2015/000185 filed Mar. 26, 2015.

International Search Report for "A Monitor for a Natural Gas-Fired Appliance", PCT/CA2014/000287 filed Mar. 26, 2014.

USPTO, Final Rejection, dated Feb. 24, 2020, re U.S. Appl. No. 15/129,177.

USPTO, Non-Final Rejection, dated May 8, 2019, re U.S. Appl. No. 15/129,177.

USPTO, Non-Final Rejection, dated Mar. 7, 2018, re U.S. Appl. No. 15/129,177.

USPTO, Final Rejection, dated Sep. 17, 2018, re U.S. Appl. No. 15/129,177.

Venstar Inc., Thermostats, venstar.com, Mar. 18, 2014. URL: http://venstar.com/Thermostats/. Retrieved from the Internet on Jun. 15, 2020, from: https://web.archive.org/web/20140318020137/http://venstar.com/Thermostats/.

Family Safety Products, Inc., "Pro Series Gas Detectors", www.familysafetyproductsinc.com, Sep. 14, 2013, Retreived from the Internet on Jun. 17, 2020 from <https://web.archive.org/web/20130914142130/http://www.familysafetyproductsinc.com/safety-siren-products/>.

* cited by examiner

MONITOR FOR A NATURAL GAS-FIRED APPLIANCE

FIELD

The specification relates generally to monitoring natural gas, and specifically to a monitor for a natural gas-fired appliance.

BACKGROUND

Natural gas-fired appliances, such as natural gas-fired furnaces, need to be serviced regularly and indeed, such servicing is statutorily regulated in many jurisdictions. However, homeowners tend to ignore the servicing, and the regulations. Reminding of homeowners can occur via home mailings but this can be ineffective as it relies on homeowners opening and responding to home mailings, for example, by calling a licensed technician to service the appliance. While a type of furnace monitoring functionality has been integrated into thermostats, such thermostats merely monitor signaling to a natural gas-fired furnace to turn it on and/or off, but do not track the number of actual cycles of a furnace. Furthermore, for natural gas-fired appliances such as natural-gas stoves and/or ovens, and the like, no monitoring generally occurs.

BRIEF DESCRIPTIONS OF THE DRAWINGS

For a better understanding of the various implementations described herein and to show more clearly how they may be carried into effect, reference will now be made, by way of example only, to the accompanying drawings in which.

SUMMARY

Figure 1:
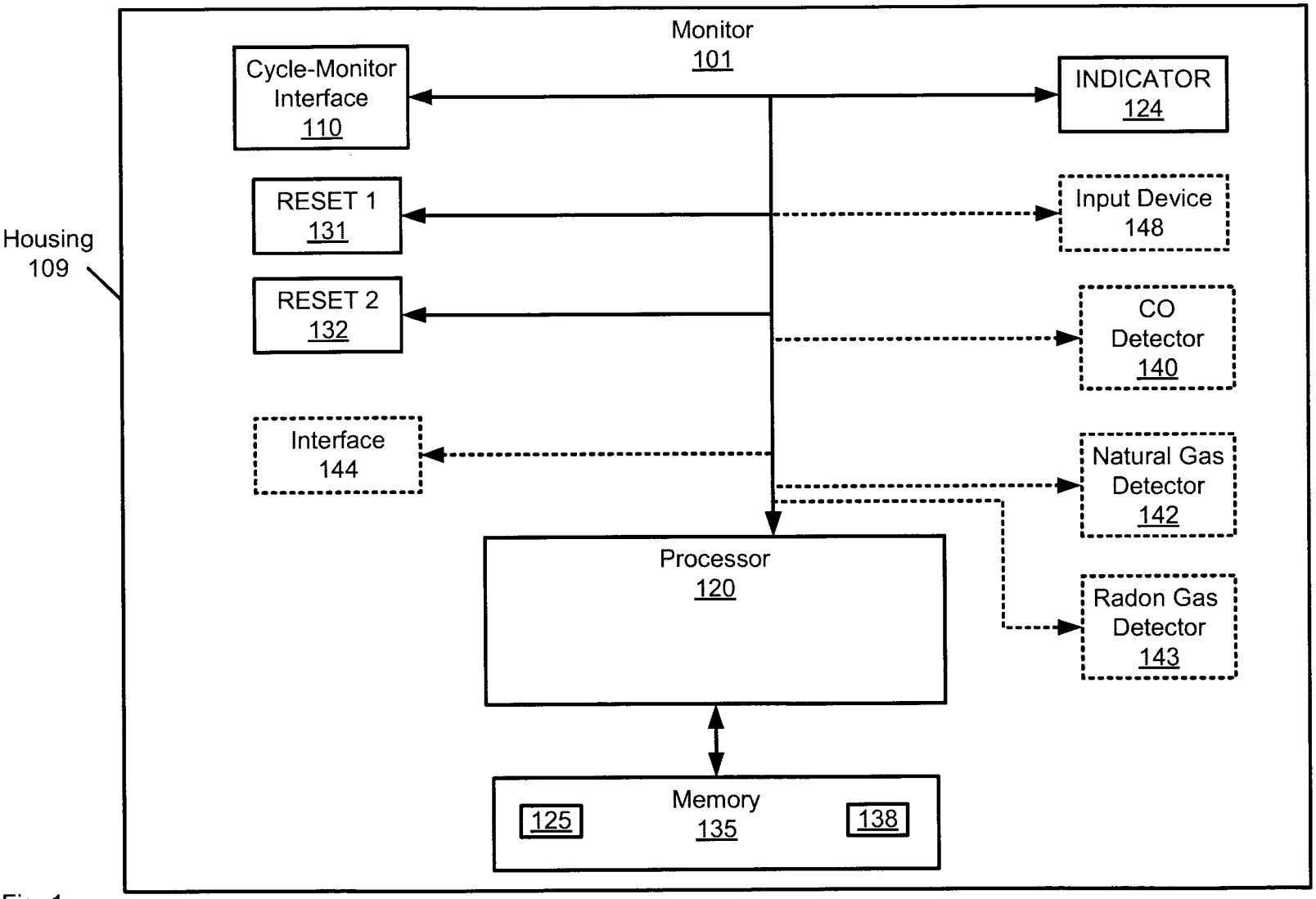
FIG. 1 depicts a schematic block diagram of a monitor for monitoring a natural gas-fired appliance, according to non-limiting implementations.

In general, this disclosure is directed to a monitor for a natural gas-fired appliance, the monitor comprising a natural gas cycle-monitor interface configured to receive cycling signals from one or more of: the natural gas-fired appliance; and a monitoring device located in at least one of the natural gas-fired appliance and proximal to the natural gas-fired appliance. The monitor provides an alarm when cycles of the appliance meets a threshold value, the alarm being indicative of a need to have the appliance serviced and/or to call a licensed technician. The alarm can be audible and/or visual, but either way provides an alert to a homeowner to have the appliance serviced. Furthermore, the monitor has a first reset device, readily accessible to a homeowner, who can temporarily reset the alarm using the first reset device. The monitor further comprises a second reset device for resetting both the alarm and monitoring of the cycles, the second reset device being accessible to a licensed technician and not the homeowner. Hence, the homeowner is forced to call the licensed technician to come reset the monitoring; otherwise the alarm will continue to provide alerts; the licensed technician can then service the appliance. The monitor can further include one or more detectors, such as detectors for natural gas, carbon monoxide, and radon gas. As well, the monitor can further include one or more interfaces for interfacing with one or more external detectors for natural gas, carbon monoxide, and/or radon gas.

In this specification, references are made to a homeowner; however such references are not to be construed solely as a person who owns a home where a natural gas-fired appliance is located. For example a homeowner as referred to herein can include, but is not limited to anyone living and/or working at a location where a natural gas-fired appliance is located, such as maintenance personnel, site managers, and the like.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

Furthermore, as will become apparent, in this specification certain elements may be described as connected physically, electronically, or any combination thereof, according to context. In general, components that are electrically connected are configured to communicate (that is, they are capable of communicating) by way of electric signals. According to context, two components that are physically coupled and/or physically connected may behave as a single element. In some cases, physically connected elements may be integrally formed, e.g., part of a single-piece article that may share structures and materials. In other cases, physically connected elements may comprise discrete components that may be fastened together in any fashion. Physical connections may also include a combination of discrete components fastened together, and components fashioned as a single piece.

It is understood that for the purpose of this specification, language of "at least one of X, Y, and Z" and "one or more of X, Y and Z" can be construed as X only, Y only, Z only, or any combination of two or more items X, Y, and Z (e.g., XYZ, XYY, YZ, ZZ, and the like). Similar logic can be applied for two or more items in any occurrence of "at least one . . . " and "one or more . . . " language.

The invention provides, in accordance with one aspect, a monitor for a natural gas-fired appliance, the monitor comprising: a natural gas cycle-monitor interface configured to receive cycling signals from one or more of: the natural gas-fired appliance; and a monitoring device located in at least one of the natural gas-fired appliance and proximal to the natural gas-fired appliance; a processor, in communication with the natural gas cycle-monitor interface, the processor configured to monitor cycles of the natural gas-fired appliance based on the cycling signals; one or more indicators, in communication with the processor, the one or more indicators configured to provide an alarm when the processor determines that the cycles of the natural gas-fired appliance meets a threshold value; a first reset device configured to temporarily reset the one or more indicators to turn off the alarm when actuated, the one or more indicators again providing the alarm after a given time period following a temporary reset; and, a second reset device configured to reset monitoring of the cycles at the processor when actuated.

Complexity of actuation of the first reset device can be less than a respective complexity of actuation of the second reset device.

The first reset device can be located at an exterior of the monitor.

The first reset device can be configured to be actuated upon receipt of pressure thereupon.

The second reset device can be located at an interior of the monitor such that the second reset device is accessible only when the monitor is physically opened. The monitor can be configured for opening only by one or more tools associated with a licensed technician.

The second reset device can be configured to be actuated by one or more of: receipt of an alphanumeric code; and an interaction with an actuation device.

The second reset device can be further configured to reset the one or more indicators to turn off the alarm until the cycles again reach the threshold value.

The monitor can further comprise: one or more mounting devices configured to mount the monitor on one or more of: the natural gas-fired appliance; and proximal to the natural gas-fired appliance.

The monitor can further comprise one or more of:

a. a carbon monoxide (CO) detector in communication with the processor; or a CO detector interface configured for communication with an external CO detector, the CO detector interface being in communication with the processor;

b. a natural gas detector in communication with the processor; or a natural gas detector interface configured for communication with an external natural gas detector, the natural gas detector interface being in communication with the processor; and/or c. a radon gas detector in communication with the processor; or a radon gas detector interface configured for communication with an external radon gas detector, the radon gas detector interface being in communication with the processor;

wherein the one or more indicators is further configured to provide a respective alarm when the processor determines that one or more of: the CO detector has detected CO, the CO detector interface has received a CO detection signal, the natural gas detector has detected natural gas, the natural gas detector interface has received a natural gas detection signal, the radon gas detector has detected radon gas, the radon gas detector interface has received a radon gas detection signal.

The natural gas cycle-monitor interface can be configured to receive the cycling signals from one or more of a gas valve at the natural gas-fired appliance and a controller at the natural gas-fired appliance, the controller being configured to control the gas valve.

In accordance with another aspect, the invention provides an appliance comprising: a natural gas-fired appliance; and, a monitor mounted to the natural gas-fired appliance and comprising: a natural gas cycle-monitor interface configured to receive cycling signals from one or more of: the natural gas-fired appliance; and a monitoring device located in at least one of the natural gas-fired appliance and proximal to the natural gas-fired appliance; a processor in communication with the natural gas cycle-monitor interface, the processor being configured to monitor cycles of the natural gas-fired appliance based on the cycling signals; one or more indicators in communication with the processor, the one or more indicators being configured to provide an alarm when the processor determines that the cycles of the natural gas-fired appliance meets a threshold value; a first reset device configured to temporarily reset the one or more indicators to turn off the alarm when actuated, the one or more indicators again providing the alarm after a given time period following a temporary reset; and, a second reset device configured to reset monitoring of the cycles at the processor when actuated.

Complexity of actuation of the first reset device can be less than the complexity of actuation of the second reset device.

The first reset device can be located at an exterior of the monitor.

The first reset device can be configured to be actuated upon receipt of pressure thereupon.

The second reset device can be located at an interior of the monitor such that the second reset device is accessible only when the monitor is physically opened. The monitor can be configured for opening only by tools associated with a licensed technician.

The second reset device can be configured to be actuated by one or more of: receipt of an alphanumeric code; and an interaction with a reset device.

The second reset device can be further configured to reset the one or more indicators to turn off the alarm until the cycles again reach the threshold value.

The monitor can further comprise one or more of:

a. a CO detector in communication with the processor; or a CO detector interface configured for communication with an external CO detector, the CO detector interface being in communication with the processor;

b. a natural gas detector in communication with the processor; or a natural gas detector interface configured for communication with an external natural gas detector, the natural gas detector interface being in communication with the processor; and c. a radon gas detector in communication with the processor; or a radon gas detector interface configured for communication with an external radon gas detector, the radon gas detector interface being in communication with the processor;

wherein the one or more indicators is further configured to provide a respective alarm when the processor determines that one or more of: the CO detector has detected CO, the CO detector interface has received a CO detection signal, the natural gas detector has detected natural gas, the natural gas detector interface has received a natural gas detection signal, the radon gas detector has detected radon gas, and the radon gas detector interface has received a radon gas detection signal.

The natural gas cycle-monitor interface can be configured to receive the cycling signals from one or more of a gas valve at the natural gas-fired appliance and a controller at the natural gas-fired appliance, the controller being configured to control the gas valve.

DETAILED DESCRIPTION

Reference will now be made to FIG. 1, which depicts a schematic block diagram of a monitor 101 for monitoring a natural gas-fired appliance, according to non-limiting implementations. The monitor 101 comprises a housing 109 which houses various components as will now be described. One component is a natural gas cycle-monitor interface 110 (interchangeably referred to hereafter as cycle-monitor interface 110), which is configured to receive cycling signals from one or more of: the natural gas-fired appliance; and a monitoring device located in at least one of the natural gas-fired appliance and proximal to the natural gas-fired appliance. Other components of the monitor 101 include a processor 120 which is in communication with the natural gas cycle-monitor interface 110. The processor 120 is configured to monitor cycles of the natural gas-fired appliance based on the cycling signals. The monitor 101 also includes one or more indicators 124, in communication with processor 120, the one or more indicators 124 being configured to provide an alarm when the processor 120 determines that the cycles of the natural gas-fired appliance meets a threshold value 125. The monitor 101 also includes a first reset device 131 configured to temporarily reset one or more indicators 124 to turn off the alarm when actuated. The one or more indicators 124, as mentioned, providing a further alarm after a given time period following a temporary reset. A second reset device 132 is configured to reset the monitoring of the cycles at the processor 120 when actuated. The monitor 101 further comprises a memory 135 which stores a threshold value 125, and an application 138 which stores the operational functionality of the monitor 101.

Cycling of a natural gas-fired appliance can generally be appreciated to occur when a flame of natural gas is ignited at the gas-fired appliance (not including a pilot light), for example to provide heating and the like; in other words, the natural gas-fired appliance is colloquially referred to as being turned "on". The flame of natural gas being ignited, i.e. when the natural gas-fired appliance being turned on, can count as one cycle or can count as a beginning of a cycle. At some point, the flame will be extinguished, i.e. the natural gas-fired appliance is turned "off", and the cycle ends. At a later time, the flame of natural gas is again ignited, i.e. the natural gas-fired appliance is again turned on, and another cycle begins. Hence, "cycling" means the repeated turning on and off of the natural gas-fired appliance, with one cycle corresponding to the flame being ignited and then extinguished.

As depicted, monitor 101 can further comprise an optional carbon monoxide ("CO") detector 140, an optional natural gas detector 142, and an optional radon gas detector 143. Alternatively, monitor 101 can comprise an optional interface to an external CO detector, an optional interface to an external natural gas detector, and an optional interface to an external radon gas detector. These optional interfaces and external detectors are not shown in FIG. 1. FIG. 1 does show, however, that the monitor can further comprise an optional communication interface 144 and an optional input device 148. All optional components are depicted in stippled lines.

Figure 2:
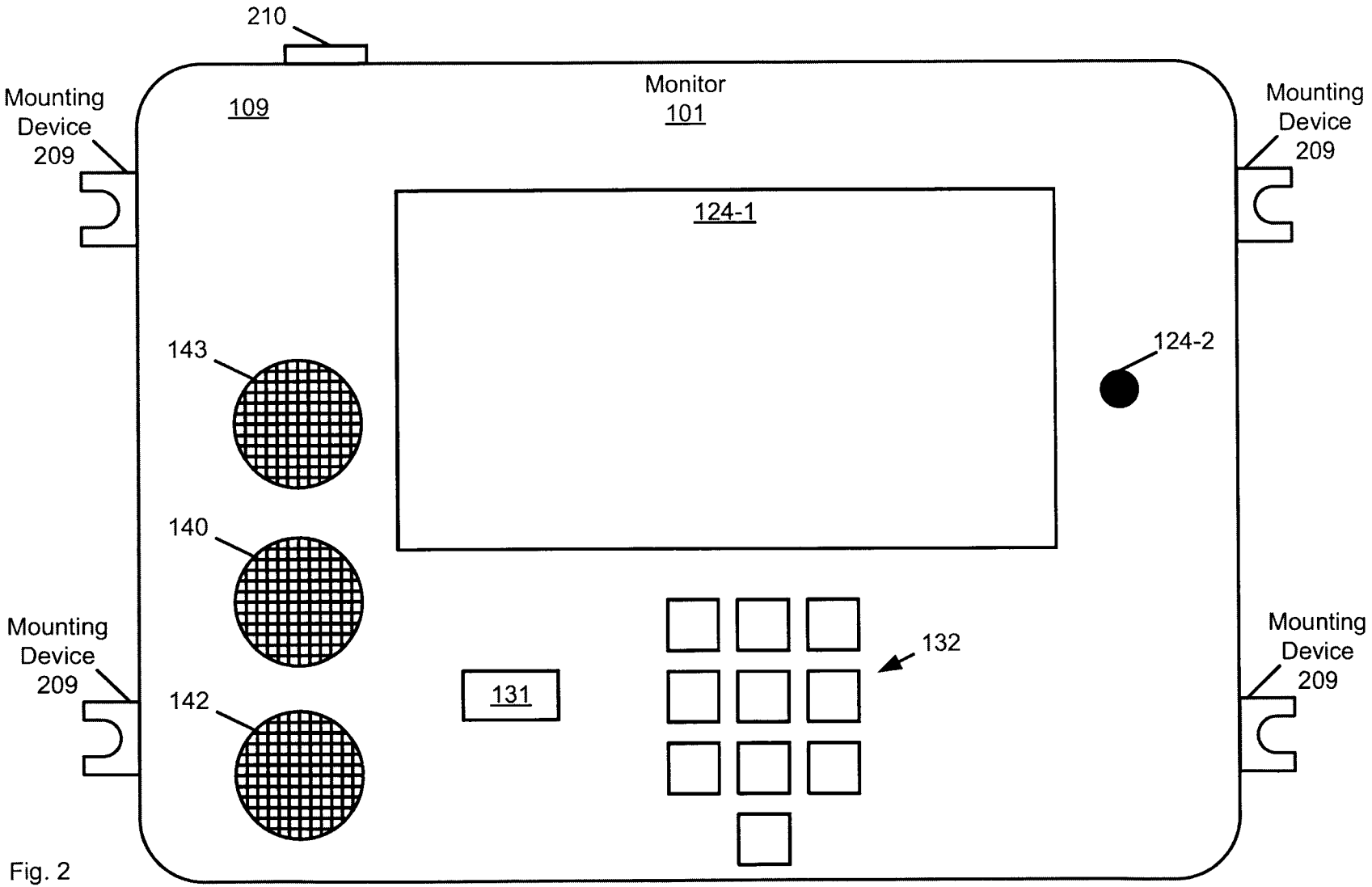
FIG. 2 depicts a front elevation view of the monitor, according to non-limiting implementations.

Reference will now be made to FIG. 2, which depicts an external front elevation view of monitor 101, according to non-limiting implementations. As can be seen in FIG. 2, external components of the monitor 101 include a housing 109, an external port and connector 210 of cycle-monitor interface 110 (shown in FIG. 1), a first indicator 124-1 comprising a display device, a second indicator 124-2 comprising a speaker, a first reset device 131, comprising an actuatable button, a second reset device 132 comprising a keypad (which can also comprise input device 148 shown in FIG. 1). External components of optional CO detector 140, optional natural gas detector 142, and optional radon gas detector 143 are also depicted, the external components comprising mesh and/or a grill, and the like, through which air can be sampled by each of the CO detector 140, natural gas detector 142, and radon gas detector 143 within monitor 101.

Further, while specific locations for each of external component of monitor 101 are depicted in FIG. 2, other locations for each component are within the scope of present implementations, including, but not limited to, on sides and/or on a rear of monitor 101 and/or housing 109. For example, connector 210 of cycle-monitor interface 110 can be located on a rear of monitor 101 and/or housing 109. However, first reset device 131 and second reset device 132 are generally located so that first reset device 131 and second reset device 132 are accessible to respectively a homeowner and/or a licensed technician when the monitor 101 is mounted on or proximal to a natural gas-fired appliance.

In depicted implementations, housing 109 comprises one or more mounting devices 209 configured to mount the monitor 101 on or proximal (near) to the natural gas-fired appliance. As depicted, each mounting device 209 comprises a U-shaped tab through which a screw, bolt and the like can be inserted to mount the monitor 101 on or near the natural gas-fired appliance. However, other configurations and types of mounting devices are within the scope of present implementations.

The housing 109 can comprise any housing, casing, chassis and the like which encloses or houses the components of monitor 101; however some components can be visible via apertures, windows and the like in housing 109. For example, first indicator 124-1, a display device, is generally visible.

Monitor 101 generally comprises a device for monitoring a natural gas-fired appliance and can comprise, in general, a computing device. Input from cycle-monitor interface 110, reset devices 131, 132, and/or input device 148, is received at processor 120 (which can be implemented as a plurality of processors, including but not limited to one or more central processors (CPUs)). Processor 120 is configured to communicate with a memory 135 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of monitor 101 as described herein are typically maintained, persistently, in memory 135 and used by processor 120 which makes appropriate utilization of volatile storage during the execution of such programming instructions. Those skilled in the art will now recognize that memory 135 is an example of computer readable media that can store programming instructions executable on processor 120. Furthermore, memory 135 is also an example of a memory unit and/or memory module.

Memory 135 further stores application 138 that, when processed by processor 120, enables processor 120 to: monitor cycles of the natural gas-fired appliance based on the cycling signals; determines that the cycles of the natural gas-fired appliance meets threshold value 125; in response, control one or more indicators 124 to provide an alarm; temporarily reset one or more indicators 124 when first reset device 131 is actuated; and reset monitoring of the cycles when second reset device 132 is actuated.

Furthermore, memory 135 storing application 138 is an example of a computer program product, comprising a non-transitory computer usable medium having a computer readable program code adapted to be executed to implement a method, for example a method stored in application 138.

Memory 135 further stores threshold value 125 which is generally indicative of the number of cycles of an appliance or length of time that the appliance is on before maintenance is required. For example, when maintenance is to occur about once per year, the threshold value 125 can comprise a number equal to an average number of cycles the natural gas-fired appliance is expected to undergo in a one year time period, and/or a length of time that the appliance is recommended to be on in a one year time period; threshold value 125 can be populated at memory 135 at a factory, and/or by a technician, and/or by a licensed technician and the like, and can be determined heuristically from monitoring natural gas-fired appliances and/or from data about natural gas-fired appliances, and the like.

Processor 120 is further configured to communicate with indicators 124, which can comprise one or more of a display (indicator 124-1) and a speaker (indicator 124-2). Indicator 124-1 comprises any suitable one of, or combination of, flat panel displays (e.g.

LCD (liquid crystal display), plasma displays, OLED (organic light emitting diode) displays, capacitive or resistive touchscreens, CRTs (cathode ray tubes) and the like. Indicator 124-2 comprises any suitable speaker for converting audio data to sound to provide audible alerts, and the like. In other implementations, the one or more indicators 124 can take other forms to provide sound, visual, textual and/or physical alarms, such as lights, LEDs (light emitting diodes), vibration devices, and other displays and speakers.

Processor 120 (FIG. 1) further connects to cycle-monitor interface 110 (FIG. 1), which comprises a connector or port 210 (FIG. 2) for connecting to an external device for detecting cycles of the natural gas-fired appliance and/or for generating cycling signals, and/or circuits and the like for receiving and/or filtering cycling signals from the external device, as described below. Connector 210 can comprise screws, and the like, for attaching one or more wires thereto. The one or more wires are used to electrically connect the cycle-monitor interface 110 to the external device so that cycling signals can be detected. In some non-limiting implementations, cycle-monitor interface 110 can communicate wirelessly (e.g. by WiFi or Bluetooth™ and the like) to the device for detecting cycles of a natural gas-fired appliance. In such implementations, the cycle-monitor interface 110 and device would each have its own wireless interface to communicate wirelessly with each other.

Referring to both FIGS. 1 and 2, processor 120 further connects to first reset device 131 and second reset device 132. Each of first reset device 131 and second reset device 132 can comprise a combination of hardware and/or software elements. For example, first reset device 131 can comprise an actuatable button, and the like, a keypad, a keyboard, a pointing device, a mouse, a track wheel, a trackball, a touchpad, a touch screen and the like. Similarly, second reset device 132 can comprise an actuatable button, and the like, a lock (actuatable via a key and the like), a keypad, a keyboard, a pointing device, a mouse, a track wheel, a trackball, a touchpad, a touch screen, and the like.

The first reset device 131 can be more easily accessible, or less complex (easier) to operate, than the second reset device 132. In one implementation, the first reset device 131 is available to be actuated by a homeowner, while the second reset device 132 is available to be accessible or actuated by a licensed technician.

Figure 17:
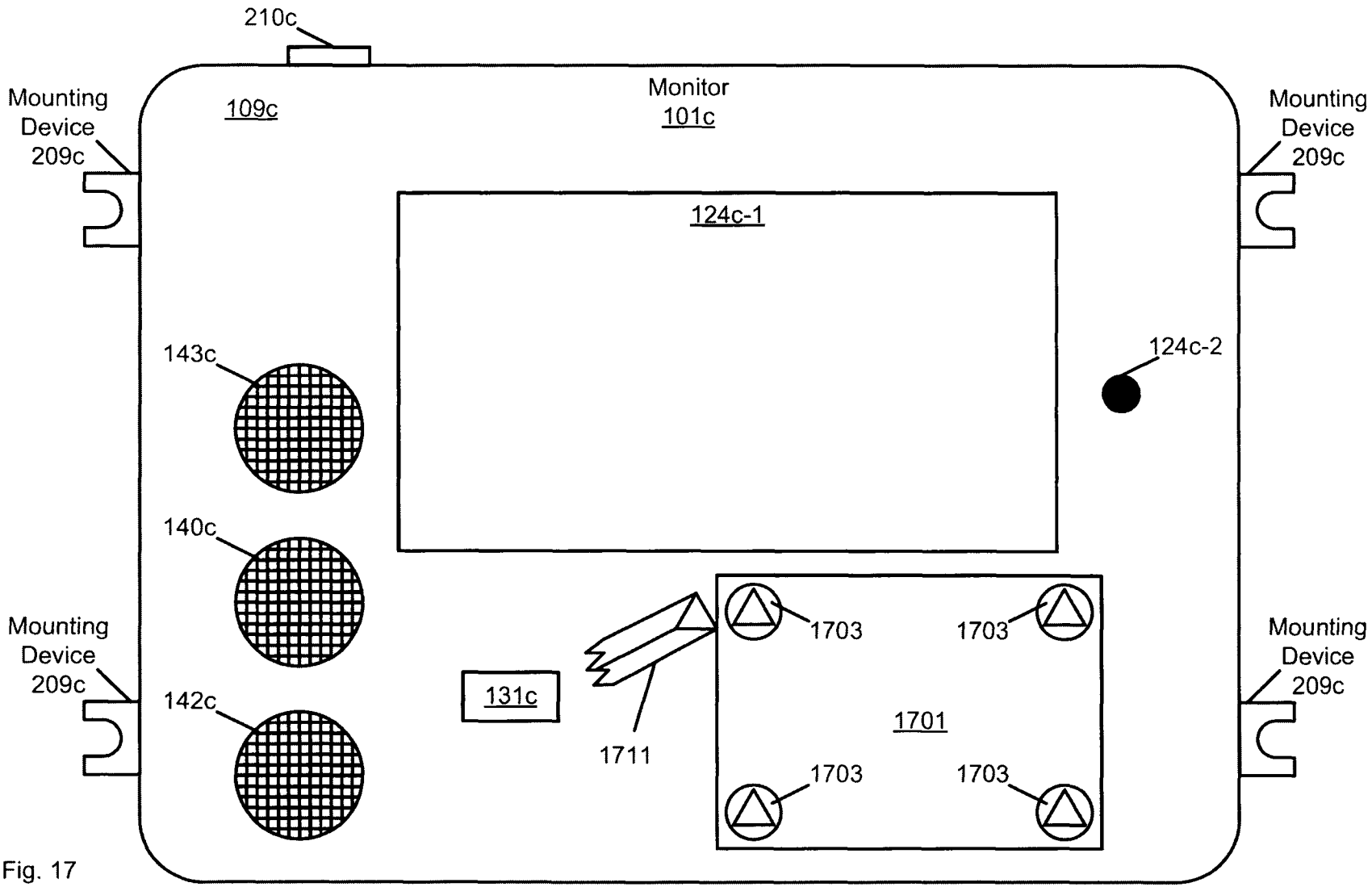
FIG. 17 depicts a front elevation view of an alternative monitor for monitoring a natural gas-fired appliance, the monitor in a closed configuration, according to non-limiting implementations.
Figure 18:
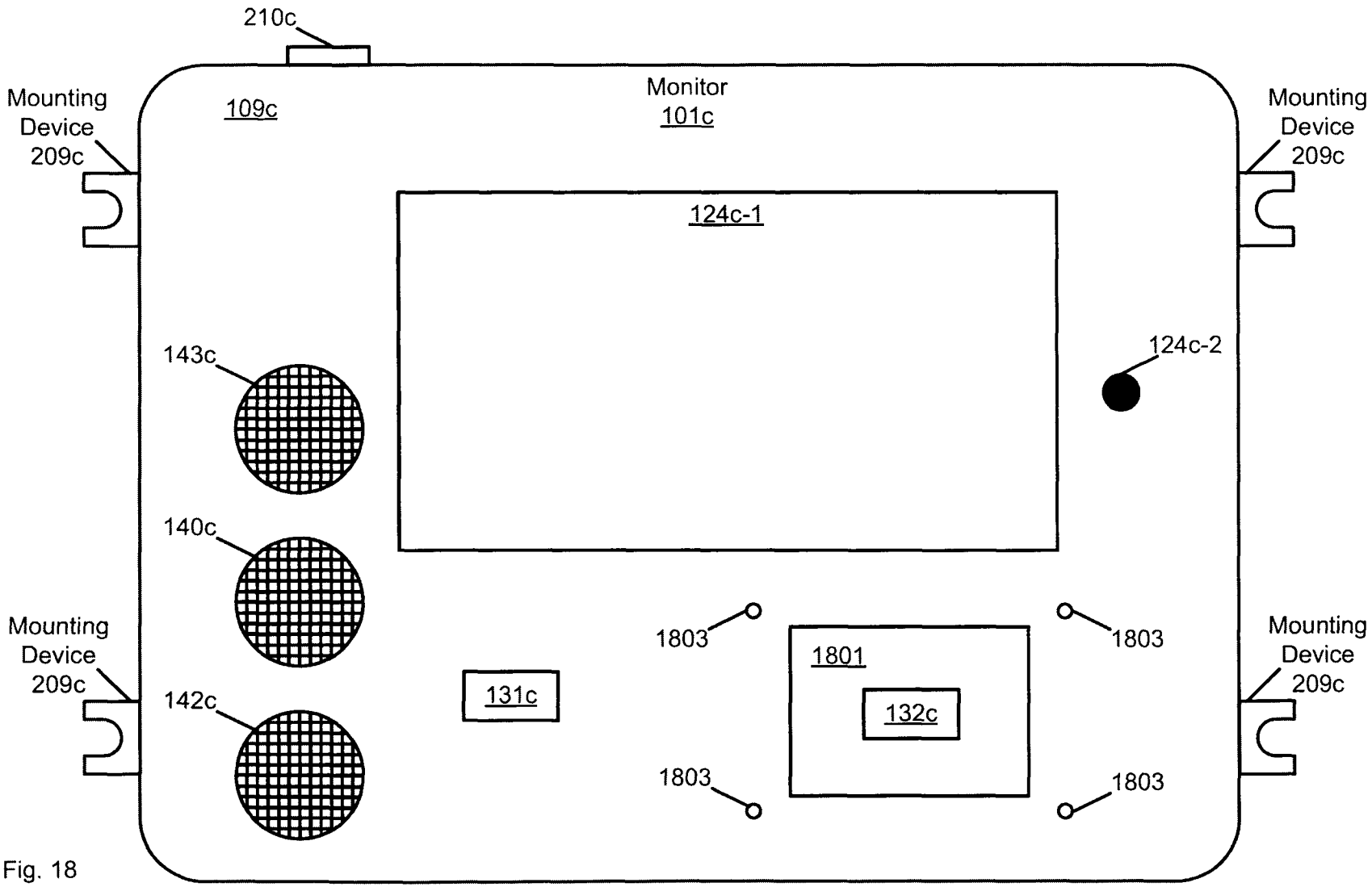
FIG. 18 depicts the monitor of FIG. 17 in an open configuration, according to non-limiting implementations.

Such accessibility can be controlled by selecting different locations for the first and second reset devices 131, 132. For example, in some implementations, first reset device 131 can be located at an exterior of the monitor 101, as depicted in FIG. 2; and the second reset device 132 can be located at an interior of monitor 101 such that the second reset device 132 is accessible only when the monitor 101 is physically opened. For example, the monitor 101 can be configured to be opened using tools associated with a licensed technician including, but not limited to, a key, special tools (e.g. customized screwdrivers and complementary screw heads), and the like, as depicted in FIGS. 17 and 18.

Such accessibility can also be controlled by making the second reset device 132 a lot more difficult to use. For example, in some implementations, the first reset device 131 can comprise a button and/or be configured to be actuated upon receipt of pressure thereupon, as depicted in FIG. 1; and the second reset device 132 can be configured to be actuated by one or more of: receipt of an alphanumeric code (e.g. second reset device 132 can comprise a keypad, as depicted in FIG. 2) provided to the licensed technician but not the homeowner, and an interaction with the second reset device 132, such as a key provided to a licensed technician but not the homeowner.

However, in some implementations, first reset device 131 and second reset device 132 can be the same device, for example, a keypad, with actuation of first reset device 131 occurring via receipt of a first alphanumeric code, and actuation of second reset device 132 occurring via receipt of a second alphanumeric code. In these implementations, the first alphanumeric code is provided to the homeowner, while the second alphanumeric code is provided to a licensed technician but not the homeowner. For example, each alphanumeric code can be set by a licensed technician, and/or at the factory, and distribution of the alphanumeric codes controlled and/or distributed in a manner which does not reveal the second alphanumeric code to the homeowner. Alternatively, first reset device 131 and second reset device 132 can comprise the same actuatable button, and the first reset device 131 and second reset device 132 can be actuatable using different actuation sequences at the button (e.g.

one press of the button to actuate first reset device 131, and a given series of presses of the button to actuate second reset device 132, the given series including, but not limited to, a combination of short presses and long presses, and the like).

Figure 16:
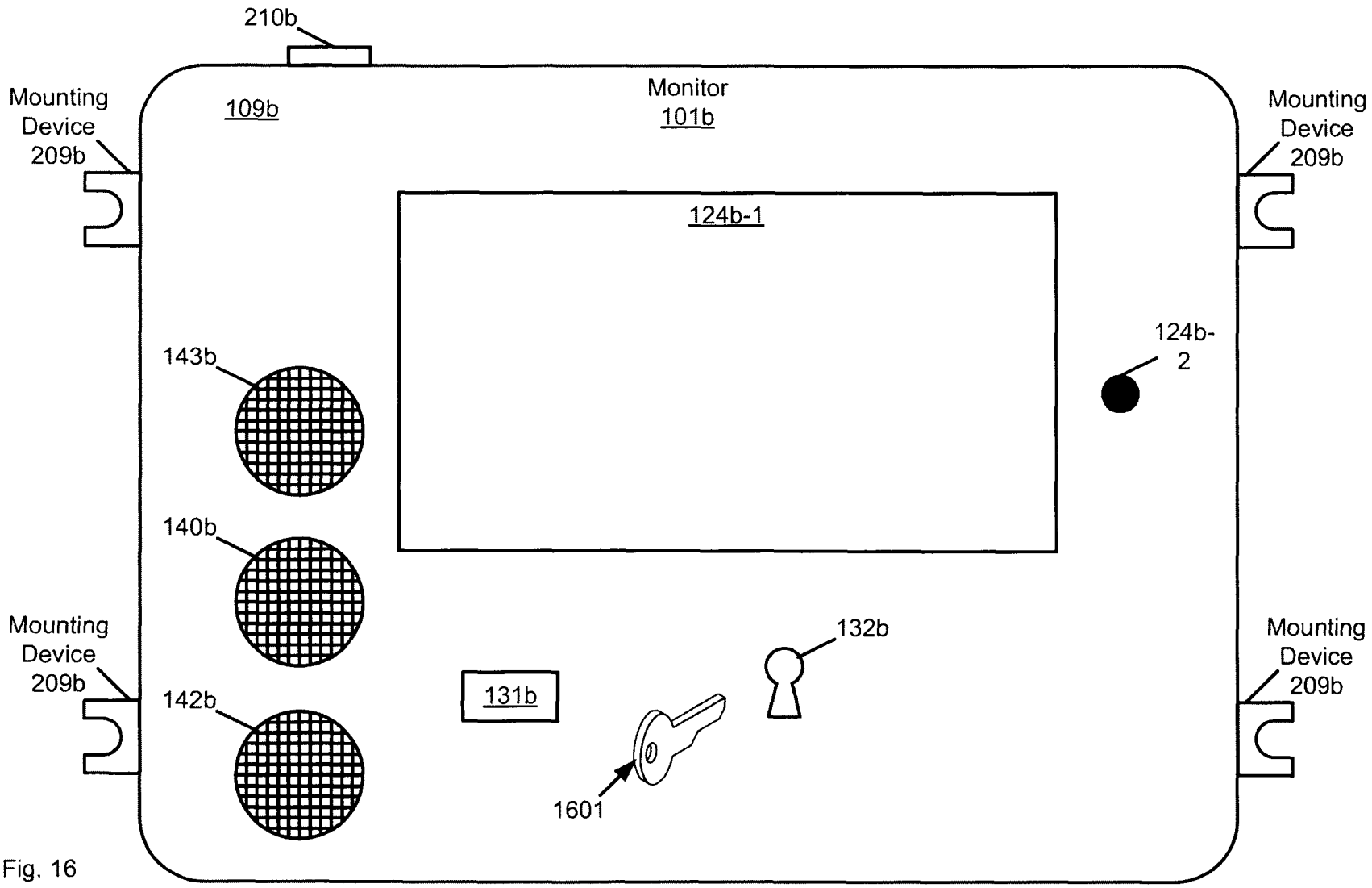
FIG. 16 depicts a front elevation view of an alternative monitor for monitoring a natural gas-fired appliance, according to non-limiting implementations.

Non-limiting examples of alternative implementations of monitor 101, with different combinations of first reset device 131 and second reset device 132 are depicted in FIGS. 16 to 18, as described below.

The optional CO detector 140 generally comprises any device for detecting carbon monoxide including, but not limited to opto-chemical detectors, biomimetic detectors, electrochemical detectors, and/or semiconductor detectors, and the like. The natural gas detector 142 generally comprises any device for detecting natural gas and/or a natural gas leak including, but not limited to electrochemical detectors, infrared point detectors, infrared imaging detectors, semiconductor detectors, ultrasonic detectors, and/or holographic detectors, and the like. Similarly, the optional radon gas detector 143 generally comprises any device for detecting radon gas that is known in the art.

The processor 120 can connect to optional CO, natural gas, and radon gas detectors or to their respective interfaces, such being interfaces for connecting to detectors mounted external to the monitor. The communication between the external detectors (CO, natural gas, radon gas) with the processor 120 can be done wirelessly, e.g. by WiFi or Bluetooth™.

Processor 120 further connects to input device 148 which is generally configured to receive input data, and can comprise any suitable combination of input devices, including but not limited to a keyboard, a keypad, a pointing device, a mouse, a track wheel, a trackball, a touchpad, a touch screen and the like. Other suitable input devices are within the scope of present implementations. In some implementations, input device 148 can be combined with one or more of first reset device 131 and second reset device 132, for example when each of first reset device 131 and second reset device 132, input device 148 comprise a common keypad.

Processor 120 also connects to optional communication interface 144 (interchangeably referred to as interface 144), which can be implemented as one or more radios and/or connectors and/or network adaptors and/or transceivers, configured to wirelessly communicate with one or more communication networks. It will be appreciated that interface 144 is configured to correspond with network architecture that is used to implement one or more communication links to the one or more communication networks, including but not limited to any suitable combination of USB (universal serial bus) cables, serial cables, wireless links, cellphone links, cellular network links (including but not limited to 2G, 2.5G, 3G, 4G+ such as UMTS (Universal Mobile Telecommunications System), GSM (Global System for Mobile Communications), CDMA (Code division multiple access), FDD (frequency division duplexing), LTE (Long Term Evolution), TDD (time division duplexing), TDD-LTE (TDD-Long Term Evolution), TD-SCDMA (Time Division Synchronous Code Division Multiple Access) and the like, wireless data, Bluetooth links, NFC (near field communication) links, WLAN (wireless local area network) links, WiFi links, WiMax links, packet based links, the Internet, analog networks, the PSTN (public switched telephone network), access points, and the like, and/or a combination thereof.

In some implementations, one or more indicators 124 can be at least partially combined with interface 144, and the processor 120 can control the indicators 124 to provide an alarm in the form of a message, an email and the like, which is wirelessly transmitted to the indicators 124 using interface 144. Such electronic messages can be transmitted to one or more of a device associated with the homeowner and/or a device associated with a licensed technician. Similarly reset devices 131, 132 can be at least partially combined with interface 144 such that resetting of alarms and/or monitoring can occur remotely using wireless messaging, and the like. Such implementations are described below with respect to FIG. 19.

While not depicted, monitor 101 further comprises a power source, for example a connection to a mains power supply and/or a power adaptor (e.g. and AC-to-DC (alternating current to direct current) adaptor, and the like). In particular non-limiting implementations, monitor 101 can be powered from a power supply at the natural gas-fired appliance. In some implementations, monitor 101 can include a battery as one or more of: a power source, an alternate power source, a backup power source and the like. In implementations that include a battery as an alternative power source and/or a backup power source, monitor 101 can include circuitry for switching to the battery as a power source in the event of a failure of the mains power supply and/or a central power supply and/or a power adaptor. Furthermore, in some of these implementations, when power is switched to the battery, processor 120 can be configured to operate monitor 101 in a monitoring mode, for example at least to monitor for carbon monoxide, natural gas, and/or radon gas (assuming CO detector 140, natural gas detector 142, and/or radon gas detector 143 are present at monitor 101). In some of these implementations, in the monitoring mode, cycle-monitor interface 110 can be turned off to preserve power, because in the event of a mains power failure, it is likely that power to the natural-gas fired appliance that is being monitored will also be unavailable and such appliance may be at least temporarily inoperable.

In any event, it should be understood that a wide variety of configurations for monitor 101 are contemplated.

Figure 3:
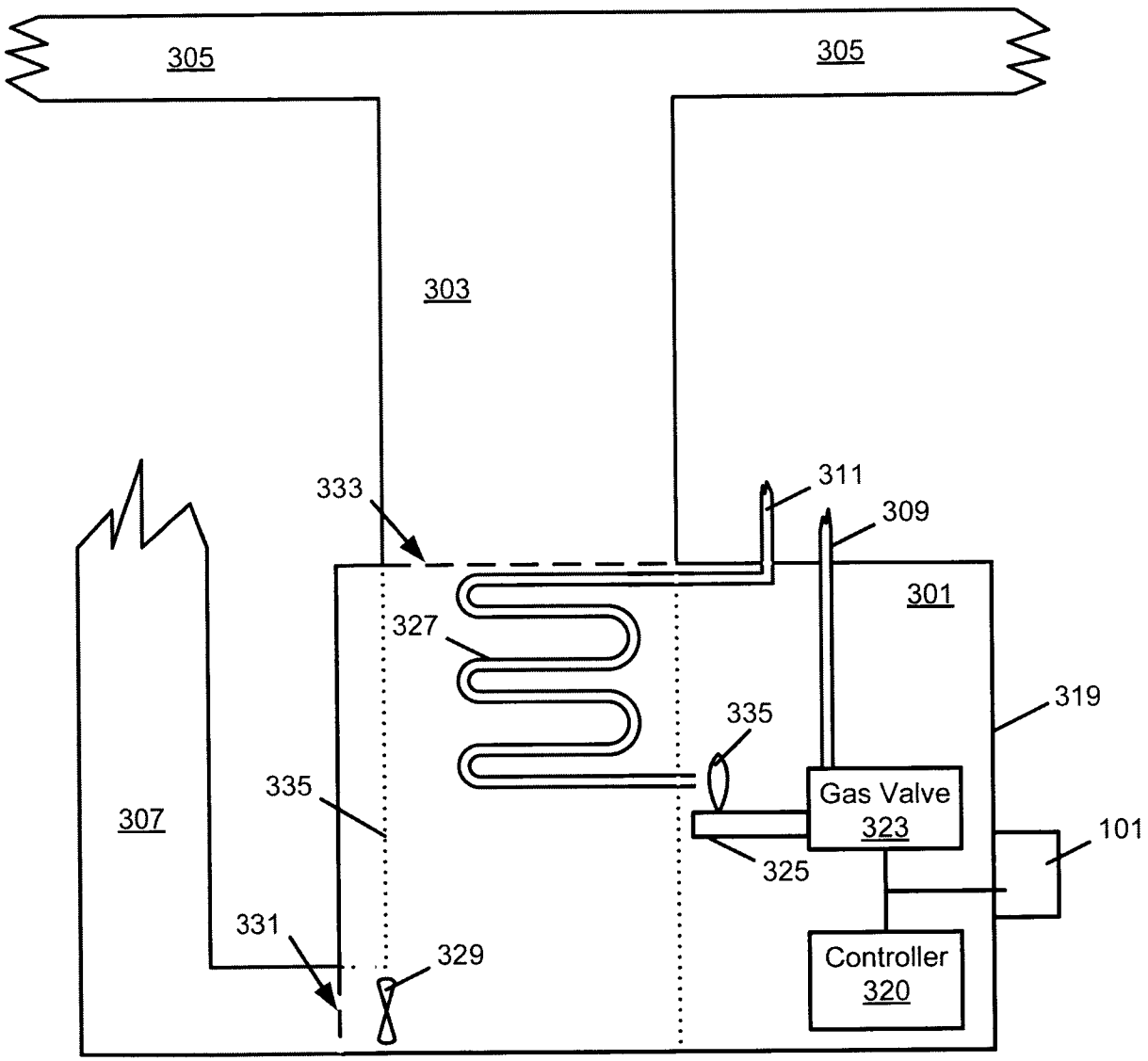
FIG. 3 depicts a system for monitoring a natural gas-fired appliance, according to non-limiting implementations.

FIG. 3 is a schematic diagram depicting a system 300 for monitoring a natural gas-fired appliance, according to non-limiting implementations. The system 300 comprises a monitor 101 installed at a natural gas-fired appliance 301, according to non-limiting implementations. Natural gas-fired appliance 301 will be interchangeably referred to hereafter as appliance 301. As depicted, appliance 301 comprises a natural gas-fired furnace, however any natural gas-fired appliance is within the scope of present implementations, including, but not limited to, boilers, air conditioners, cookers, barbecues, heaters, stoves, ovens, dryers, hot water heaters, and the like.

System 300 further comprises a plenum 303 connected to appliance 301, supply air ducts 305 connected to plenum 303, and an intake duct 307, a gas supply tube 309, and an exhaust 311, each connected to appliance 301. Only a portion of each of supply air ducts 305, intake duct 307, gas supply tube 309, and exhaust 311 are depicted for clarity.

Appliance 301 generally comprises a chassis 319, a controller 320, a gas valve 323, a burner 325, one or more heat exchangers 327, a circulation fan 329, an input aperture 331 and an output aperture 333, as well as a duct 305 between input aperture 331 and output aperture 333, one or more heat exchangers 327 located between the intake duct 307 and the supply air ducts 305. While not depicted, appliance 301 can further comprise filters and the like for filtering air passing there through. While not depicted, system 300 can further comprise a thermostat, and controller 320 can be connected to the thermostat located, for example on a premises being heated by appliance 301.

Also, while not depicted, system 300 can further comprise, but is not limited to one or more of: an air conditioning unit, a heat pump, an air cleaner, a media air cleaner, a humidifier, a heat recovery system, an energy recovery system, a fresh air system, an air filtration system, a HEPA (high-efficiency particulate absorption) bypass filtration system, and the like. In other words, system 300 can further comprise, but is not limited to, an HVAC (heating, ventilation, and air conditioning) system. However, such HVAC components are appreciated to be optional.

In operation, when controller 320 receives a signal from the thermostat, controller 320 controls a fan to turn "on", and further transmits a signal (for example a cycling signal and/or a gas-valve actuation signal) to gas valve 323 to cause gas valve 323 to open, such that natural gas from gas supply tube 309 flows to burner 325. One or more flames 335 at burner 325 are ignited (e.g. using a pilot light, an electronic ignition, and the like), which then heats one or more heat exchangers 327. Fan 329 draws air through input aperture 331 and circulates the air past one or more heat exchangers 327; one or more heat exchangers 327 heat the air, which flows into plenum 303 and is circulated to air ducts on the premises via supply air ducts 305. Exhaust from flame 335 and/or one or more heat exchangers 327 is exhausted via exhaust 311 (e.g. the exhaust from one or more flames 335 can be directed into tubing of one or more heat exchangers 327 which, as depicted, are exhausted via exhaust 311).

While not depicted, controller 320 and/or gas valve 323 and/or burner 325 are powered from an electrical connection to a power supply and/or a mains power supply, and the like. In some implementations, controller 320 is connected to the power supply, and controller 320 can distribute power to gas valve 323 and/or burner 325, for example via wiring. Further, controller 320 and/or appliance 301 can comprise an AC (alternating current) to DC (direct current) converter for converting AC power from the power supply to DC power for powering circuits of gas valve 323 and/or burner 325.

As depicted, monitor 101 is mounted on chassis 319, though monitor 101 can alternatively be mounted adjacent appliance 301. In some implementations, monitor 101 can be integrated into appliance 301 and/or chassis 319. In these implementations, appliance 301 can be sold with monitor 101 as a component of appliance 301.

Either way, monitor 101 can be powered via a connection to controller 320 and/or an AC to DC converter at appliance 301.

While, as depicted, appliance 301 comprises a furnace, present implementations are not so limiting. For example, while chassis 319, heat exchanger 327, exhaust 311, fan 329, and apertures 331, 333 are specific to a furnace, other natural gas-fired appliances can be lacking these components. However, natural gas-fired appliances will in general comprise a controller, a gas valve and a burner, which can be respectively similar to controller 320, gas valve 323 and burner 325, though each of these components can be adapted for functionality of a specific given appliance. For example, burners for a stove can be different from burners for a furnace.

Furthermore, monitor 101 and/or cycle-monitor interface 110 can be configured to receive cycling signals from gas valve 323, controller 320 and/or a connection there between.

Figure 4:
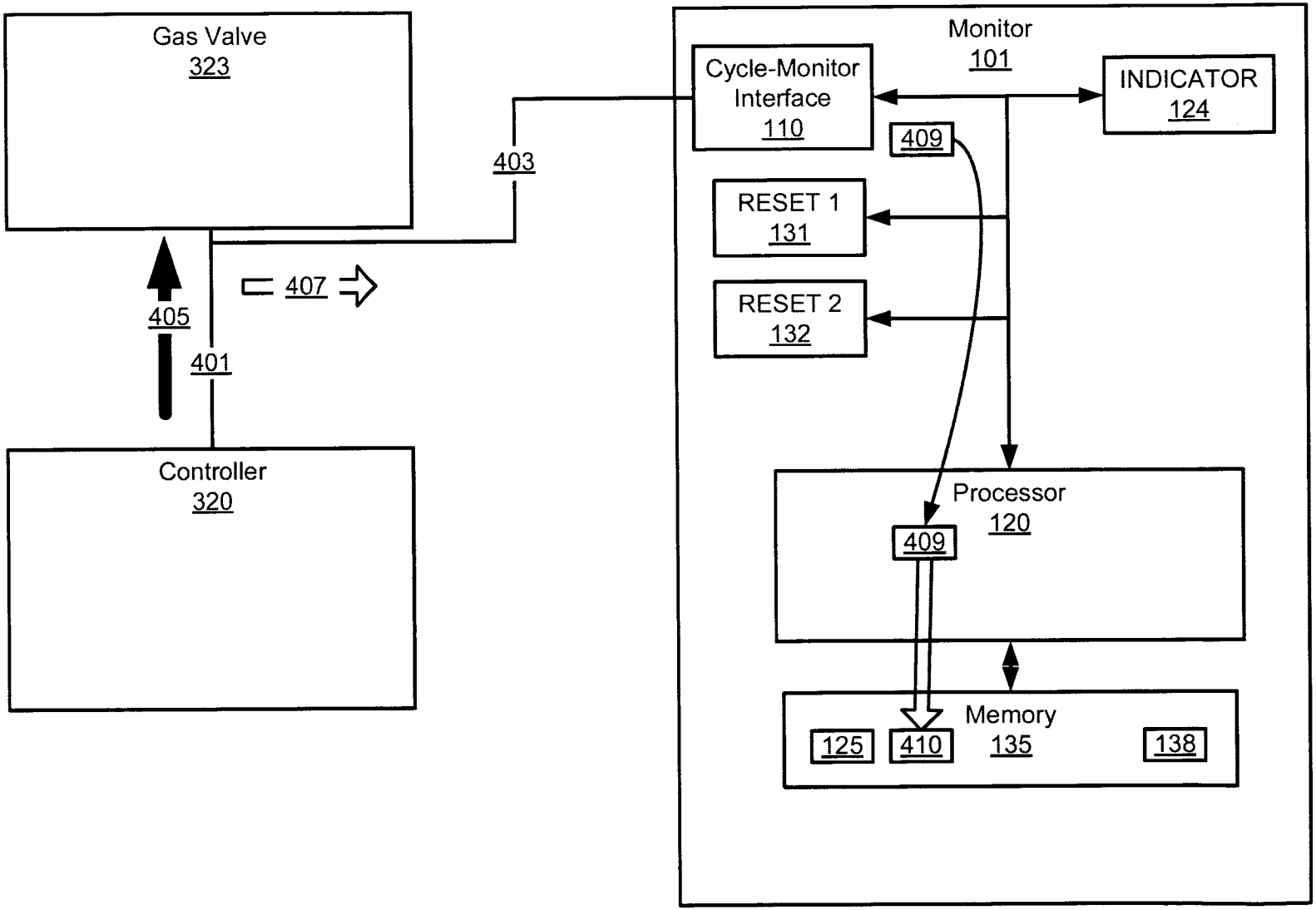
FIG. 4 depicts connections between components of the natural gas-fired appliance and the monitor, according to non-limiting implementations.

For example, referring now to FIG. 4, which is a schematic diagram depicting connections between components of the natural gas-fired appliance and the monitor, according to non-limiting implementations. There are connections between controller monitor 101, controller 320 and gas valve 323. Furthermore, while not all components of monitor 101 are depicted for simplicity, they are appreciated to be nonetheless present. As is apparent from FIG. 4, controller 320 is connected to gas valve 323 via a connection 401, and cycle-monitor interface 110 of monitor is connected to connection 401 via a connection 403. When a cycling signal 405 is transmitted from controller 401 to gas valve 323, at least a portion 407 of cycling signal 405 is conveyed to cycle-monitor interface 110 via connection 403. In other words, in these implementations, cycle-monitor interface 110 comprises a device for sampling cycling signal 405 from connection 401 via connection 403, without otherwise interfering with cycling signal 405 and/or preventing gas valve 323 from opening flow of natural gas to burner 325. Hence, in these implementations, cycle-monitor interface 110 can comprise a voltage detector and/or a current detector and the like. Cycling signal 405 generally comprises a gas-valve actuation signal, which signals gas valve 323 to open, such that natural gas from gas supply tube 309 flows to burner 325.

When cycle-monitor interface 110 detects at least a portion 407 of cycling signal 405, cycle-monitor interface 110 provides a signal 409 to processor 120, which then generates and/or updates current cycle data 410 at memory 135; current cycle data 410 generally comprises one or more of: a number of cycles that has occurred at appliance 301 since appliance was last serviced, and/or a total amount of time that the appliance has been on since last serviced; when appliance 301 is serviced, and/or no cycles have occurred at appliance 301, current cycle data 410 is "0".

At some point controller 320 will control gas valve 323 to close; at a later time, controller 320 will again transmit cycling signal 405 to gas valve 323, and cycle-monitor interface 110 will again detect at least a portion 407 of cycling signal 405, and again processor 120 will update current cycle data 410 at memory 135.

Figure 5:
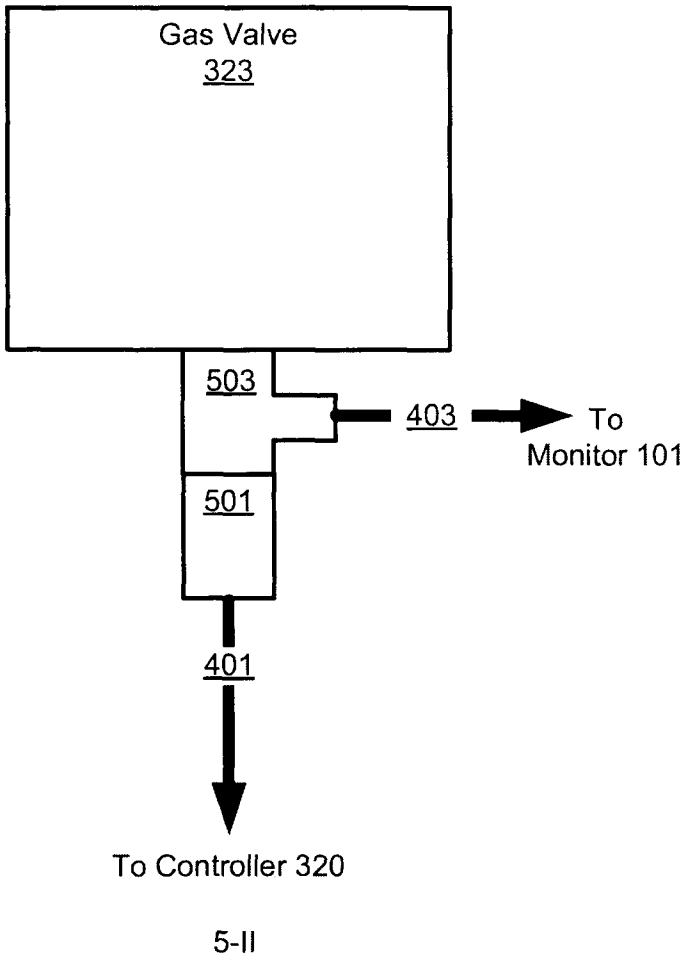
FIG. 5 depicts connections to a gas valve of the natural gas-fired appliance according to the prior art and according to non-limiting implementations.
Figure 5:
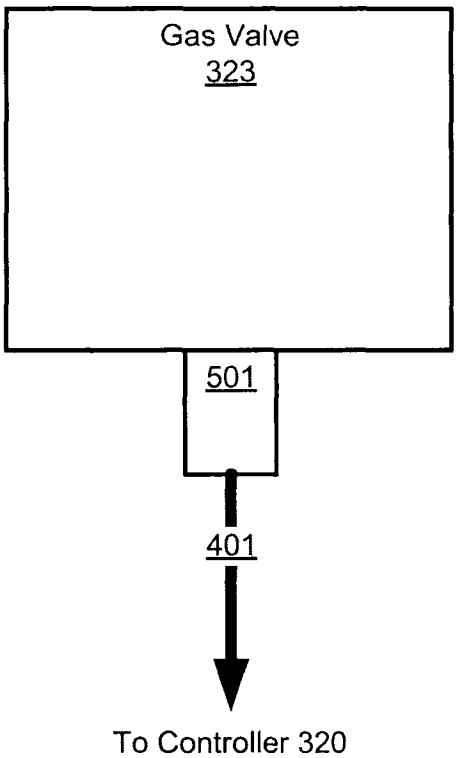

Each of connections 401, 403 can comprise wires, connectors and the like, as desired. For example, attention is next directed to FIG. 5, which depicts a view 5-I of gas valve 323, and a portion of connection 401 according to the prior art, and a view 5-II of gas valve 323 and a portion of each of connections 401, 403 according to non-limiting implementations. In view 5-I of the prior art, connection 401 comprises a connector 501 which interfaces with a corresponding port of gas valve 323. In view 5-II, a T-connector 503 is inserted between gas valve 323 and connector 501. T-connector 503 interfaces with the corresponding port of gas valve 323 and connector 501, and provides an electrical connection between connection 401 and monitor 101, and specifically cycle-monitor interface 110.

T-connector 503 can be inserted between connector 501 and gas valve 323 without otherwise affecting and/or altering and/or changing the electronic and/or electrical components of appliance 301. For example, some jurisdictions have regulations regarding altering and/or changing the electronic and/or electrical components of natural gas-fired appliances, and specifically natural gas furnaces and/or boilers. Hence, T-connector 503 can be used to tap into connection 401 without otherwise altering and/or changing the electronic and/or electrical components of appliance 301 and still comply with regional statutes. In some implementations, T-connector 503 can be used at a port and/or connector at controller 320.

However, while T-connector 503 is provided as a specific non-limiting example for tapping into connection 401, any node into which three electrical conductors converge and/or electrically connect can be used in system 300 and/or inserted between controller 320 and gas valve 323. Specifically, as with T-connector 503, two conductors of the node provide and/or restore electrical continuity between controller 320 and gas valve 323, while a third conductor provides a sample of cycling signal 405 (e.g. a gas valve-actuation signal) to processor 120 to serve as the cycle-count signal.

Hence, the term "T-connector" can be used to generally refer to any node into which three electrical conductors converge, as described above; for example, a T-connector need not strictly be in the shape of a letter "T".

Otherwise, without judicial oversight, connection 403 can be implemented by electrically connecting to connection 401 in any manner including, but not limited to, tapping into connection 401 (i.e. scraping away insulation and connecting to exposed wires), and the like. However, any such connections should be performed in a manner that does not decrease safety at appliance 301, as natural gas could ignite in the presence of sparks, exposed live wires, etc.

Figure 6:
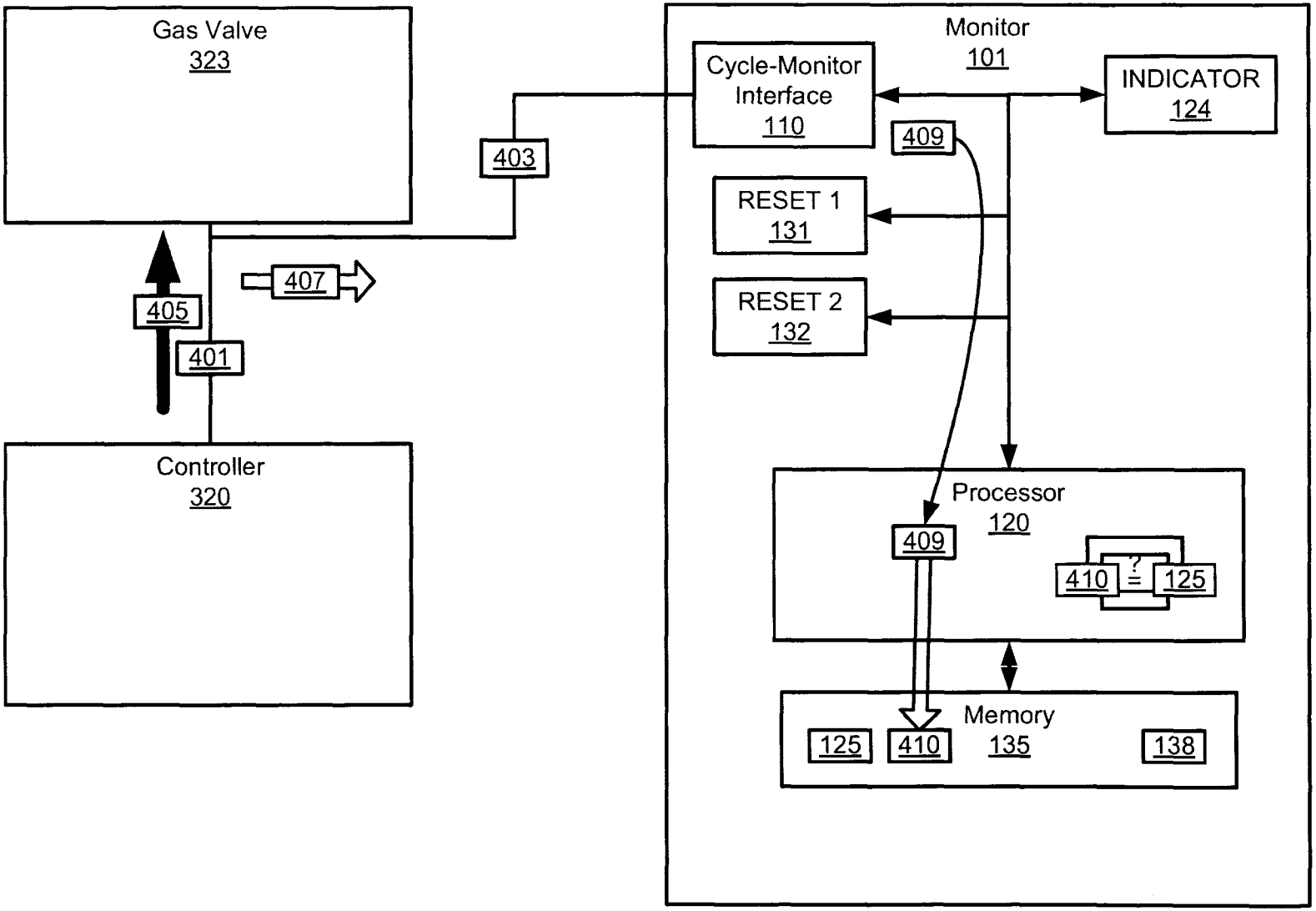
FIG. 6 depicts the monitor monitoring a cycling signal of the natural gas-fired appliance, according to non-limiting implementations.

FIG. 6 is substantially similar to FIG. 4, with like elements having like numbers. In FIG. 6, processor 120 is again processing a signal 409 indicative of detecting cycle-monitor signal 405, and comparing current cycle data 410 to threshold value 125. When current cycle data 410 meets threshold value 125, processor 120 controls one or more indicators 124 to provide an alarm. Current cycle data 410 can meet threshold value 125 when current cycle data 410 is equal and/or about equal to threshold value 125.

Figure 7:
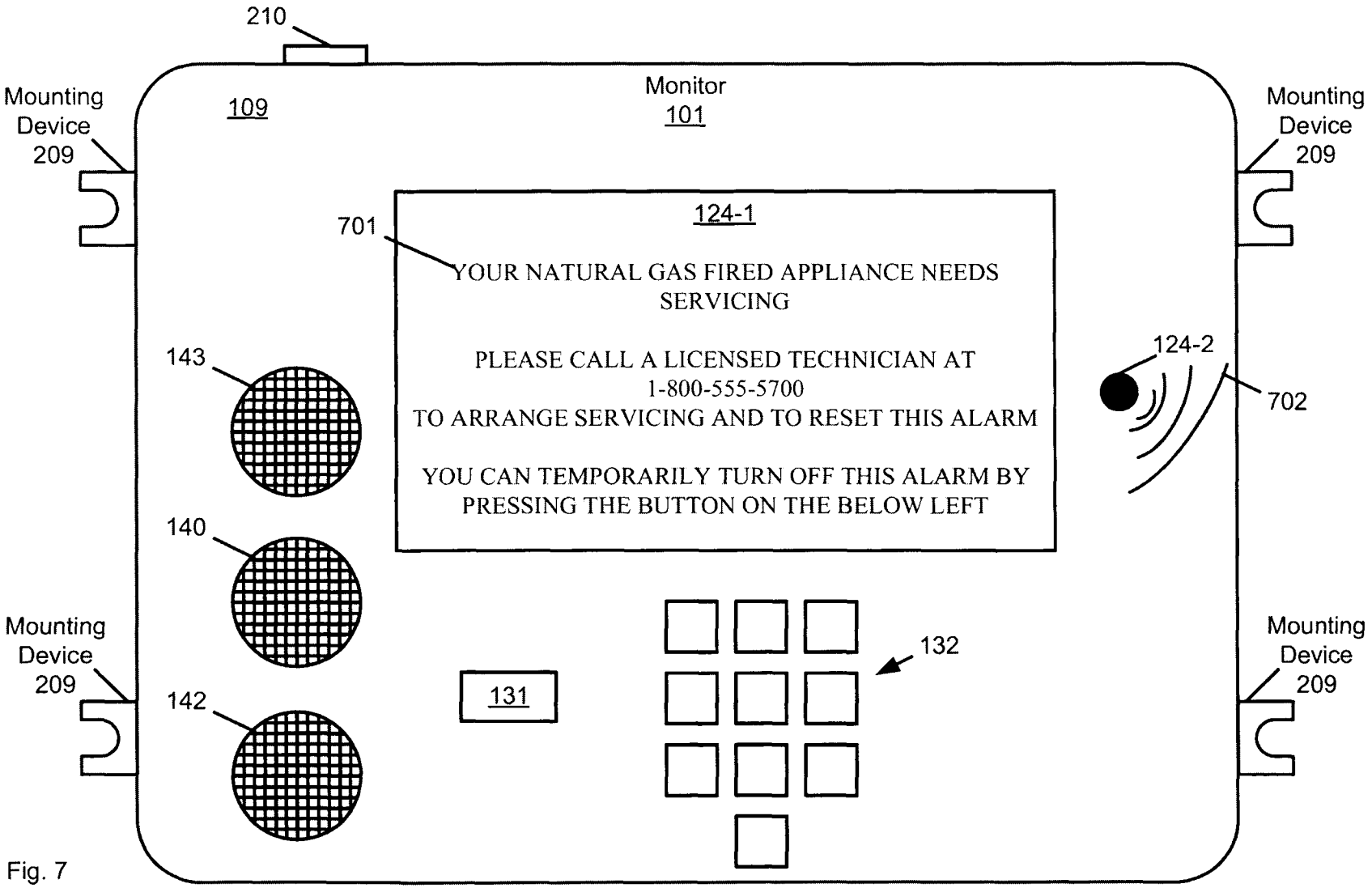
FIG. 7 depicts the monitor providing alarms, according to non-limiting implementations.

For example, attention is next directed to FIG. 7, which is substantially similar to FIG. 2, with like elements having like numbers. In FIG. 7, it is assumed that processor 120 has determined that current cycle data 410 meets threshold value 125, processor 120 controls indicator 124-1 to provide a textual alarm 701 and/or controls indicator 124-2 to provide an audible alarm 702. Textual alarm 701, as depicted, can provide information on why alarms 701, 702 are occurring, instructions on how to contact a licensed technician, and/or instructions on how to temporarily reset alarms 701, 702. Audible alarm 702 can comprise spoken words similar to textual alarm 701, which are repeated until audible alarm 702 is at least temporarily reset, and/or a ringing noise, a buzzing noise, and the like.

Figure 8:
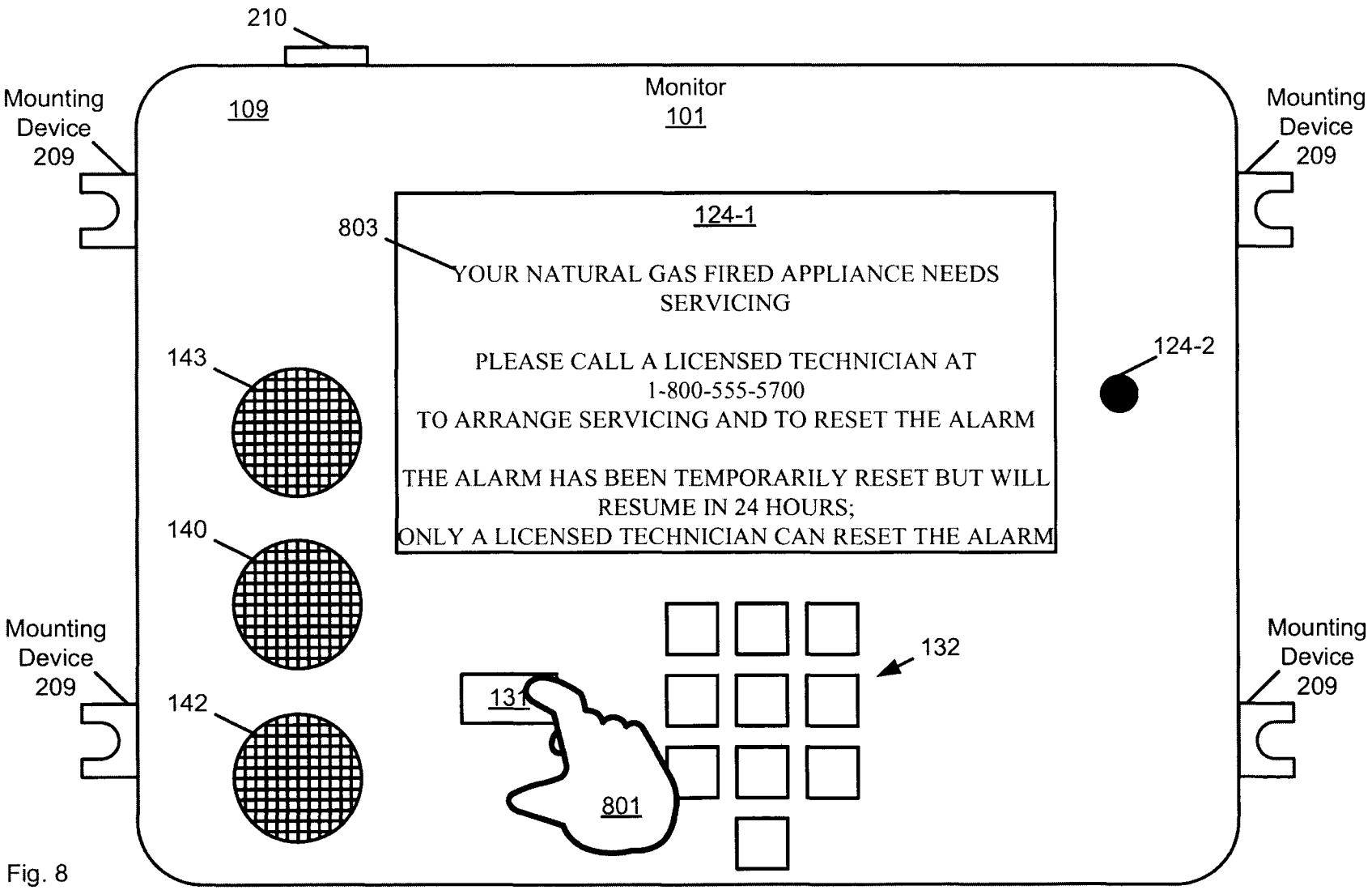
FIG. 8 depicts a temporary reset of the monitor, according to non-limiting implementations.

Attention is next directed to FIG. 8, which is substantially similar to FIG. 7, with like elements having like numbers. In FIG. 8, a hand 801 of a homeowner is shown actuating a first reset device 131 by pressing first reset device 131. As such, alarms 701, 702 are temporarily reset. For example, audible alarm 702 is temporarily turned off and/or instructions on how to turn off alarms 701,702 are removed from indicator 124-1. However, indicator 124-1 can continue to provide instructions 803 on how to contact a licensed technician, and can further provide a warning that alarms 701, 702 are only temporarily reset.

After a given time period, for example 24 hours, and the like, alarms 701, 702 can be provided again, to again alert homeowner 801 to contact a licensed technician.

In some implementations, monitor 101 can further comprise a clock which tracks a time of day, and processor 120 can be further configured to provide audible alarm 702 only outside of night time hours, so as to not disturb the homeowner while the homeowner is sleeping. Such time restrictions on audible alarms do not apply to alarms related to detection of carbon monoxide, natural gas and/or radon gas, as described below, as such alarms can provide immediately time-sensitive information to the homeowner.

Figure 9:
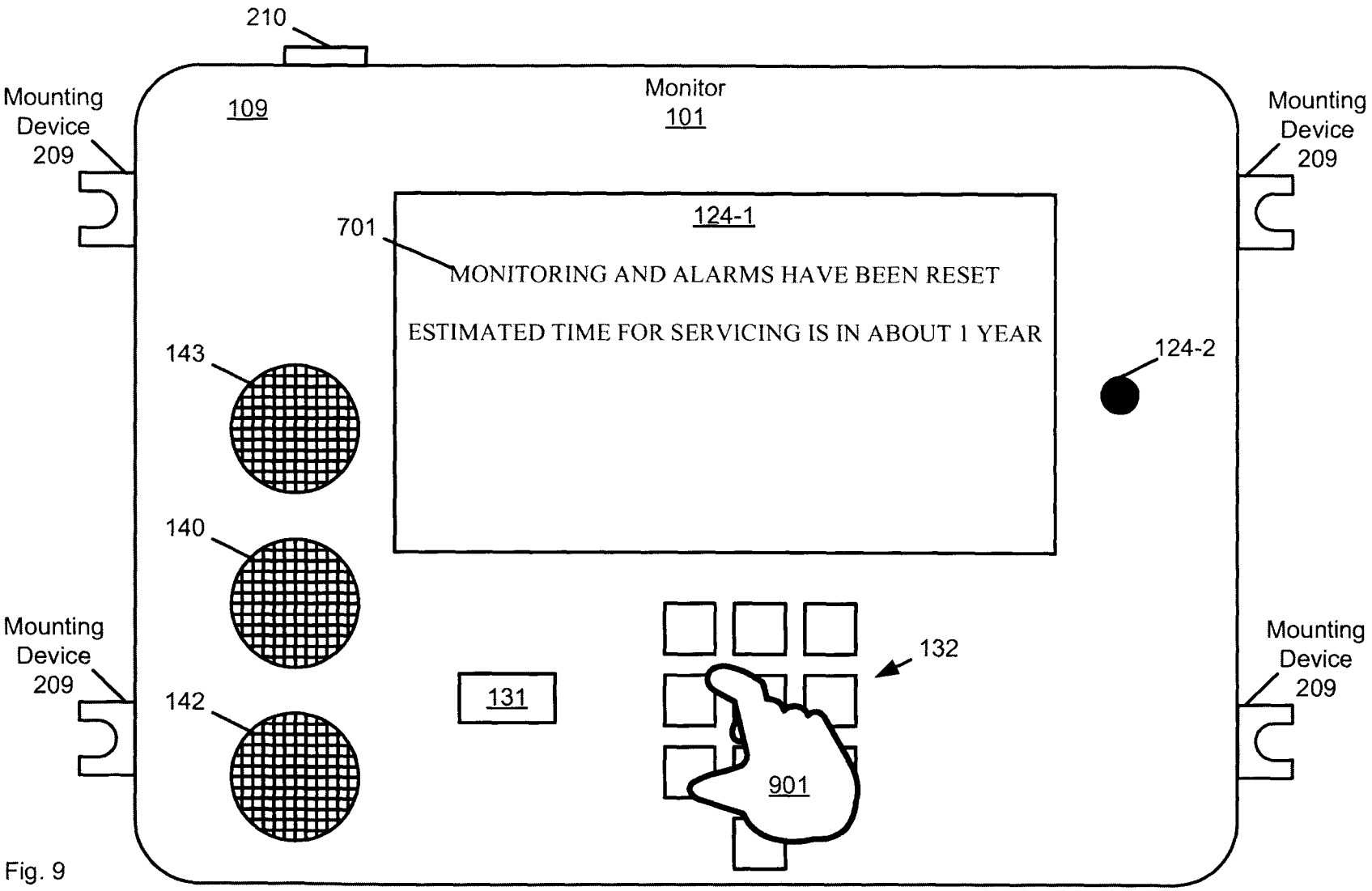
FIG. 9 depicts a reset of the monitoring of the cycling of the natural gas-fired appliance at the monitor, according to non-limiting implementations.

Attention is next directed to FIG. 9, which is substantially similar to FIG. 8, with like elements having like numbers. In FIG. 9, however, it is assumed that homeowner has contacted a licensed technician whose hand 901 is shown actuating the second reset device 132 by entering an alphanumeric code at second reset device 132 (i.e. the keypad). In some implementations, as depicted, indicator 124-1 can provide an indication that monitoring and/or alarms 701 have been reset, and/or an estimated time until next servicing (i.e. about 1 year from a date that second reset device 132 is actuated). In other words, second reset device 132 can be configured to reset one or more indicators 124 to turn off the alarm(s) until the cycles again meet threshold value 125.

Figure 10:
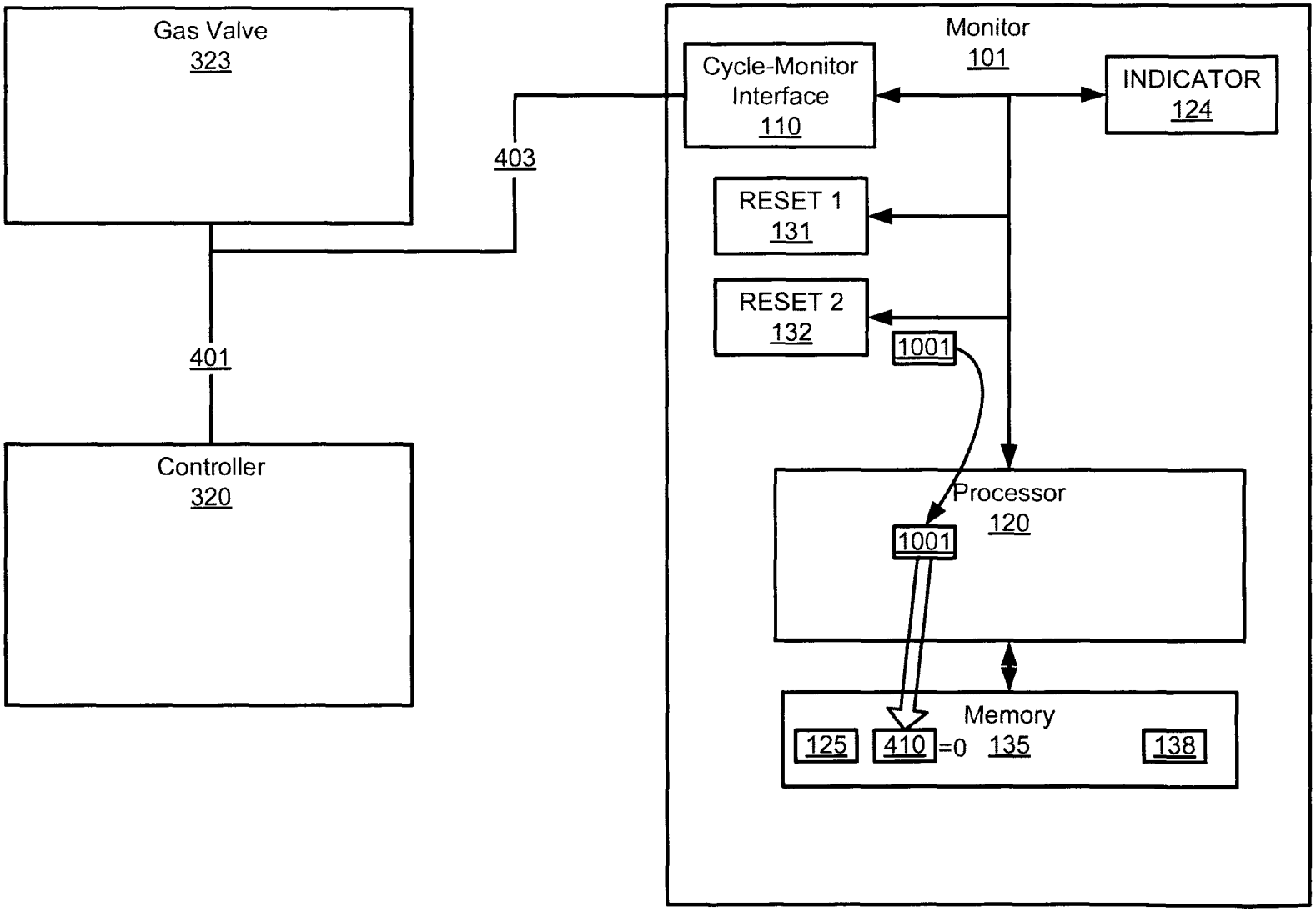
FIG. 10 depicts a reset of the monitoring of the cycling of the natural gas-fired appliance at the monitor, according to non-limiting implementations.

As depicted in FIG. 10, which is substantially similar to FIG. 6, with like elements having like numbers, when second reset device 132 is actuated, it sends a signal 1001 to the processor 120, which processes the signal 1001 and, in response, sets current cycle data 410 to "0", thereby resetting monitoring of appliance 301.

Figure 11:
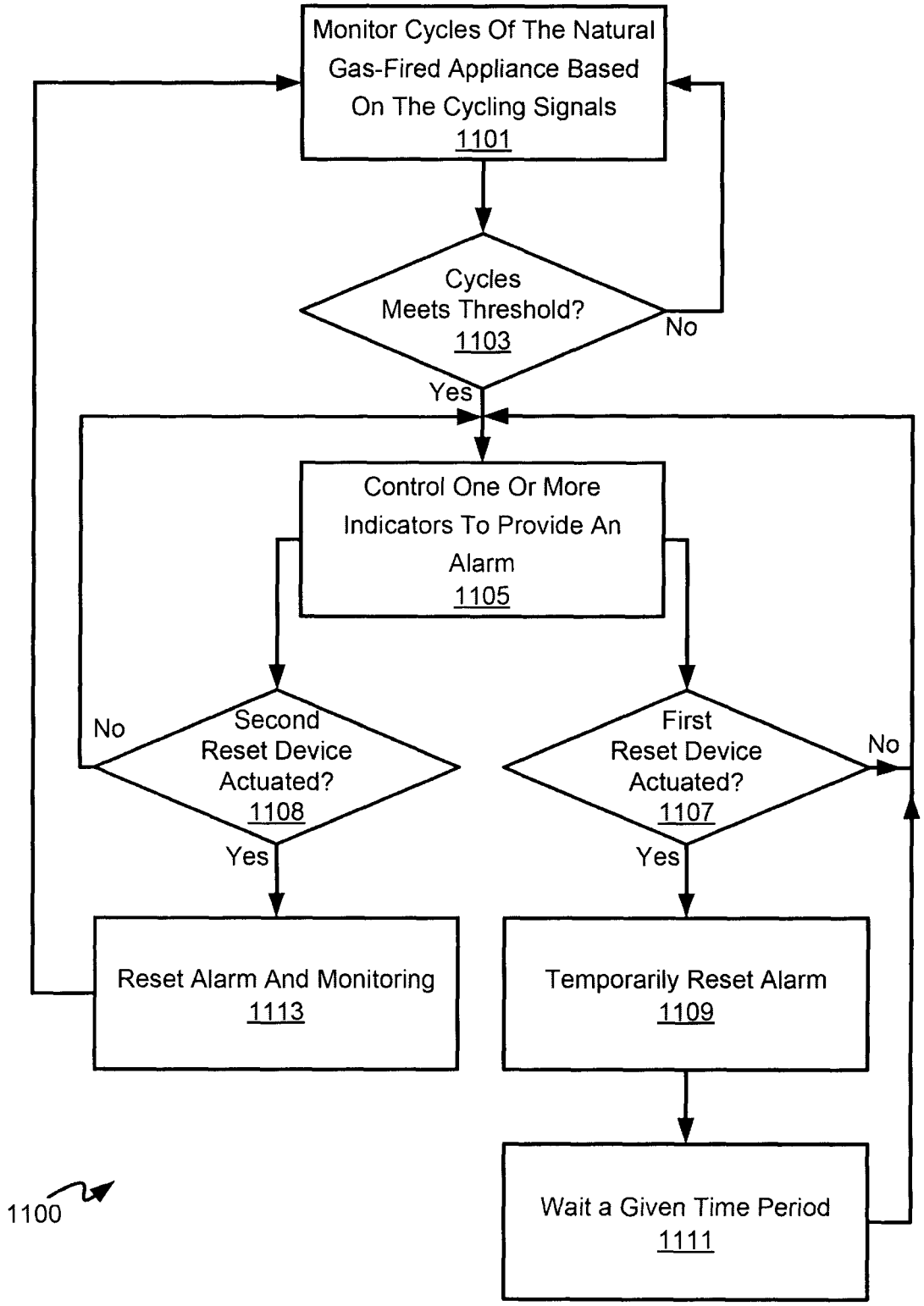
FIG. 11 depicts a flowchart of a block diagram of a method for monitoring a natural gas-fired appliance, according to non-limiting implementations.

Attention is now directed to FIG. 11 which depicts a flowchart illustrating a method 1100 of monitoring a natural-gas fired appliance, according to non-limiting implementations. In order to assist in the explanation of method 1100, it will be assumed that method 1100 is performed using monitor 101. Furthermore, the following discussion of method 1100 will lead to a further understanding of monitor 101 and its various components. However, it is to be understood that monitor 101 and/or method 1100 can be varied, and need not work exactly as discussed herein in conjunction with each other, and that such variations are within the scope of present implementations. It is appreciated that, in some implementations, method 1100 is implemented in monitor 101 by processor 120, for example by implementing application 138.

It is to be emphasized, however, that method 1100 need not be performed in the exact sequence as shown, unless otherwise indicated; and likewise various blocks may be performed in parallel rather than in sequence; hence the elements of method 1100 are referred to herein as "blocks" rather than "steps". It is also to be understood that method 1100 can be implemented on variations of monitor 101 as well.

A block 1101, processor 120 monitors cycles of a natural gas-fired appliance based on cycling signals, for example received from one or more of: the natural gas-fired appliance; and a monitoring device located at least one of in the natural gas-fired appliance and proximal to the natural gas-fired appliance.

At block 1103, processor 120 determines whether cycles of the natural gas-fired appliance meets threshold value 125; if not (a "No" decision at block 1103), block 1101 is again implemented while if so (a "Yes" decision at block 1103), at block 1105, processor 120 controls one or more indicators 124 to provide an alarm as described above. When a "No" decision occurs at blocks 1101, blocks 1101, 1103 can repeat until cycles of natural gas-fired appliance meet threshold value 125. As also described above, providing the alarm can be restricted to occur within given times of day, for example, exclusive of times when a homeowner is likely to be asleep.

Processor 120 then monitors first reset device 131 and second reset device 132 for actuation at blocks 1107, 1108 which can occur in parallel with each other. When neither are actuated (a "No" decision at one or both of blocks 1107, 1108), alarm continues to be provided. When first reset device 131 is actuated (a "Yes" decision at block 1107), at block 1109 processor 120 temporarily resets the alarm, wait a given time period at block 1111 and the again control one or more indicators 124 to provide an alarm at block 1105.

When second reset device 132 is actuated (a "Yes" decision at block 1108), at block 1109 processor 120 resets the alarm, if activated, and the monitoring, as described above, and block 1101 repeats. It is appreciated that a "Yes" decision can occur at block 1108 while any one of blocks 1107, 1109, 1111 are being implemented; when this occurs, the functionality of blocks 1107, 1109 and/or 1111 is interrupted and method 1100 defaults to block 1113 and then to block 1101.

Heretofore, implementations of cycle monitoring of appliance 301 by monitor 101 and have been based on monitoring gas valve 323. However, other methods of cycle monitoring are within the scope of present implementations. For example, attention is next directed to FIG. 12, which is substantially similar to FIG. 3, with like elements having like numbers, however, system 300 has been modified to include one or more cycling detectors 1201-1, 1201-2, 1201-3, 1201-4 referred to hereafter collectively as cycling detectors 1201 and generically as a cycling detector 1201.

Further monitor 101 and/or cycle-monitor interface 110 is not connected to controller 320/gas valve 323, but rather one or more cycling detectors 1201. In other words each of one or more cycling detectors 1201 generally comprises a monitoring device for monitoring cycling at appliance 301 and is configured to detect cycling of appliance 301 and provide a cycling signal to monitor 101 and/or cycle-monitor interface 110. Connections and/or links between each cycling detector 1201 and monitor 101 are depicted in heavy lines.

As depicted cycling detector 1201-1 is located adjacent burner 325 and can comprise one or more of a flame detector, a spectral detector (e.g. for detecting an optical spectrum of flame 335) and the like; when cycling detector 1201-1 detects flame 335, cycling detector 1201-1 generates a cycling signal which is transmitted to monitor 101 and/or cycle-monitor interface 110 via a suitable link and/or connection thereto.

As depicted, cycling detector 1201-2 is located adjacent and/or proximal to one or more of the following: heat exchangers 327, output aperture 333 and in plenum 303. The cycling detector 1201-2 can comprise a temperature detector, and the like. When cycling detector 1201-2 detects an increase in temperature, cycling detector 1201-3 generates a cycling signal which is transmitted to monitor 101 and/or cycle-monitor interface 110 via a suitable link and/or connection thereto.

Similarly, cycling detector 1201-3 is located within a supply air duct 305, and can comprise a temperature detector, and the like. When cycling detector 1201-3 detects an increase in temperature, cycling detector 1201-3 generates a cycling signal which is transmitted to monitor 101 and/or cycle-monitor interface 110 via a suitable link and/or connection thereto.

Similarly, cycling detector 1201-4 is located within an adapting duct 1205 which has been attached to supply air duct 305, and can comprise a temperature detector, and the like. When cycling detector 1201-4 detects an increase in temperature, cycling detector 1201-4 generates a cycling signal which is transmitted to monitor 101 and/or cycle-monitor interface 110 via a suitable link and/or connection thereto.

As temperature detectors can be sensitive to moisture and/or environments inside plenums and air ducts, adapting air duct 1205 can be attached to a supply air duct 305, and/or plenum 303, to sample air there from, while protecting cycling detector 1201-4 from conditions within supply air duct 305 and/or plenum 303. In some implementations, as depicted, adapting duct 1205 can be "L" shaped, however other shapes are within the scope of present implementations.

However, other locations for cycling detectors 1201 and other types of cycling detectors 1201 are within the scope of present implementations, as long as a combination of a type of cycling detector 1201 and location thereof can detect a cycle of appliance 301.

Figure 12:
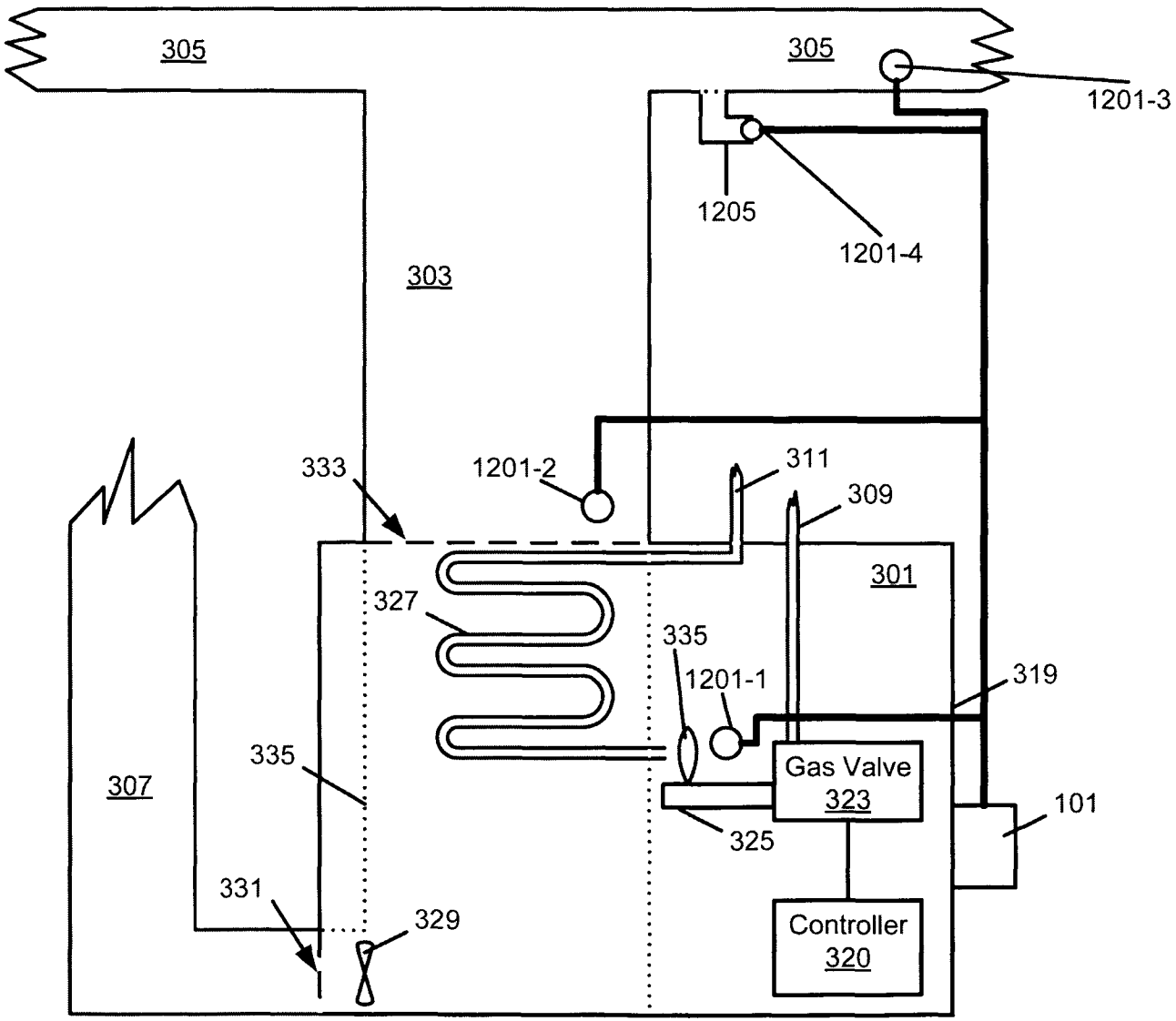
FIG. 12 depicts an alternative system for monitoring a natural gas-fired appliance, according to non-limiting implementations.

While four cycling detectors 1201 are depicted in FIG. 12, in other implementations, system 300 (including, but not limited to optional HVAC components) can comprise more than four cycling detectors are fewer than four cycling detectors, for example one cycling detector.

Figure 13:
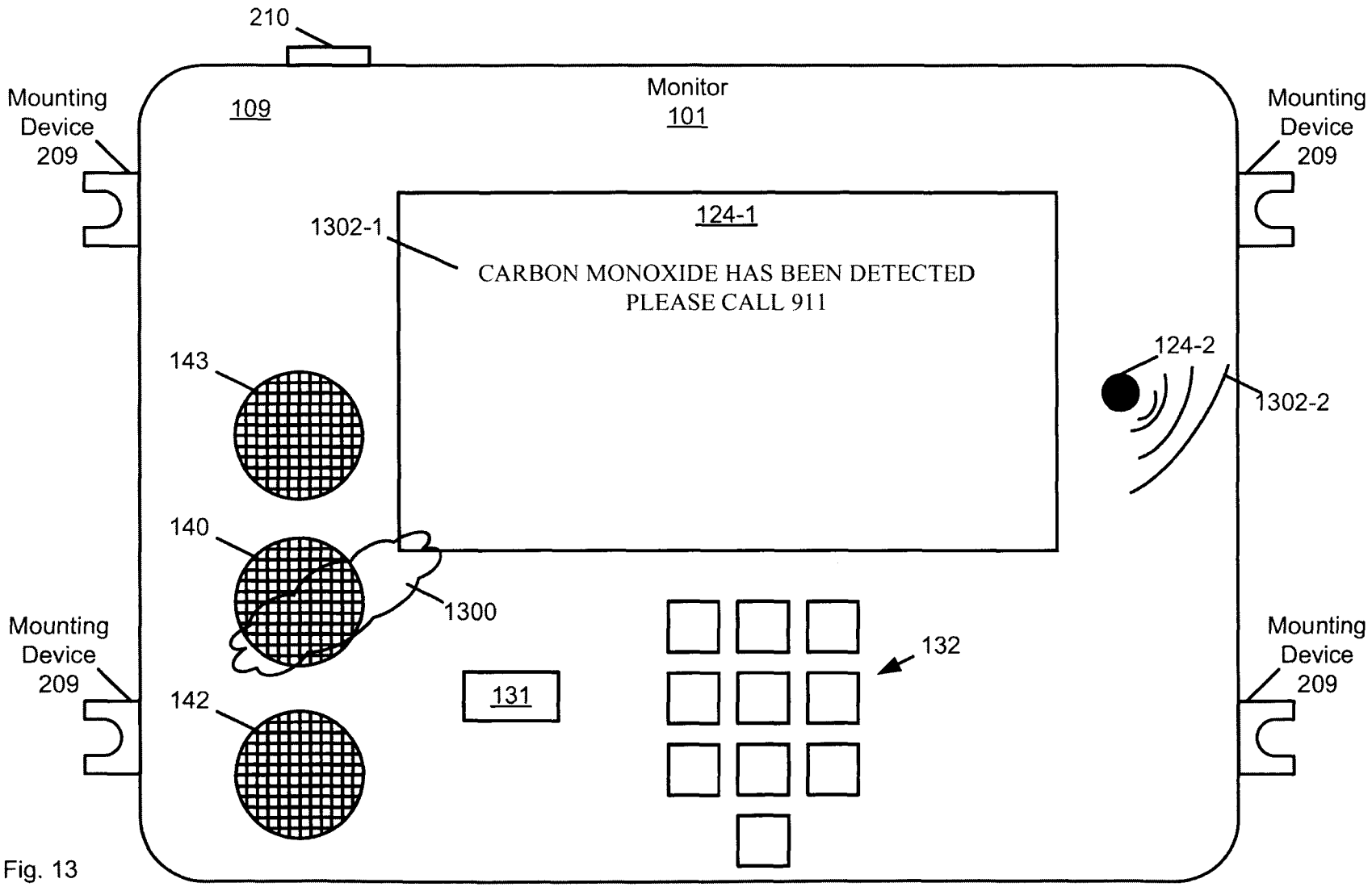
FIG. 13 depicts the monitor detecting carbon monoxide, according to non-limiting implementations.

Attention is next directed to FIG. 13, which is substantially similar to FIG. 2, with like elements having like numbers. In these implementations, CO gas 1300 is detected by the CO detector 140, and alarms 1302-1, 1302-2 are provided respective indicators 124-1, 124-2 to warn the homeowner that CO gas 1300 has been detected. In some of these implementations, one or more of reset devices 131, 132 can be used to reset alarms 1302-1, 1302-2. For example, first reset device 131 can be used to temporarily reset alarms 1302-1, 1302-2, which alarms 1302-1, 1302-2 can be provided again after a given time period; and second reset device 132 can be used to reset alarms 1302-1, 1302-2 until CO gas is again detected. Similar to implementations described above, resetting alarms 1302-1, 1302-2 using second reset device 132 can occur using a given alphanumeric code that is known to a licensed technician and/or emergency personnel, but not to a homeowner. In alternative implementations, however, alarms 1302-1, 1302-2 cannot be reset using first reset device 131 and/or by a homeowner to encourage the homeowner to call a licensed technician and/or emergency personnel, due to the implicit danger of CO gas.

Figure 14:
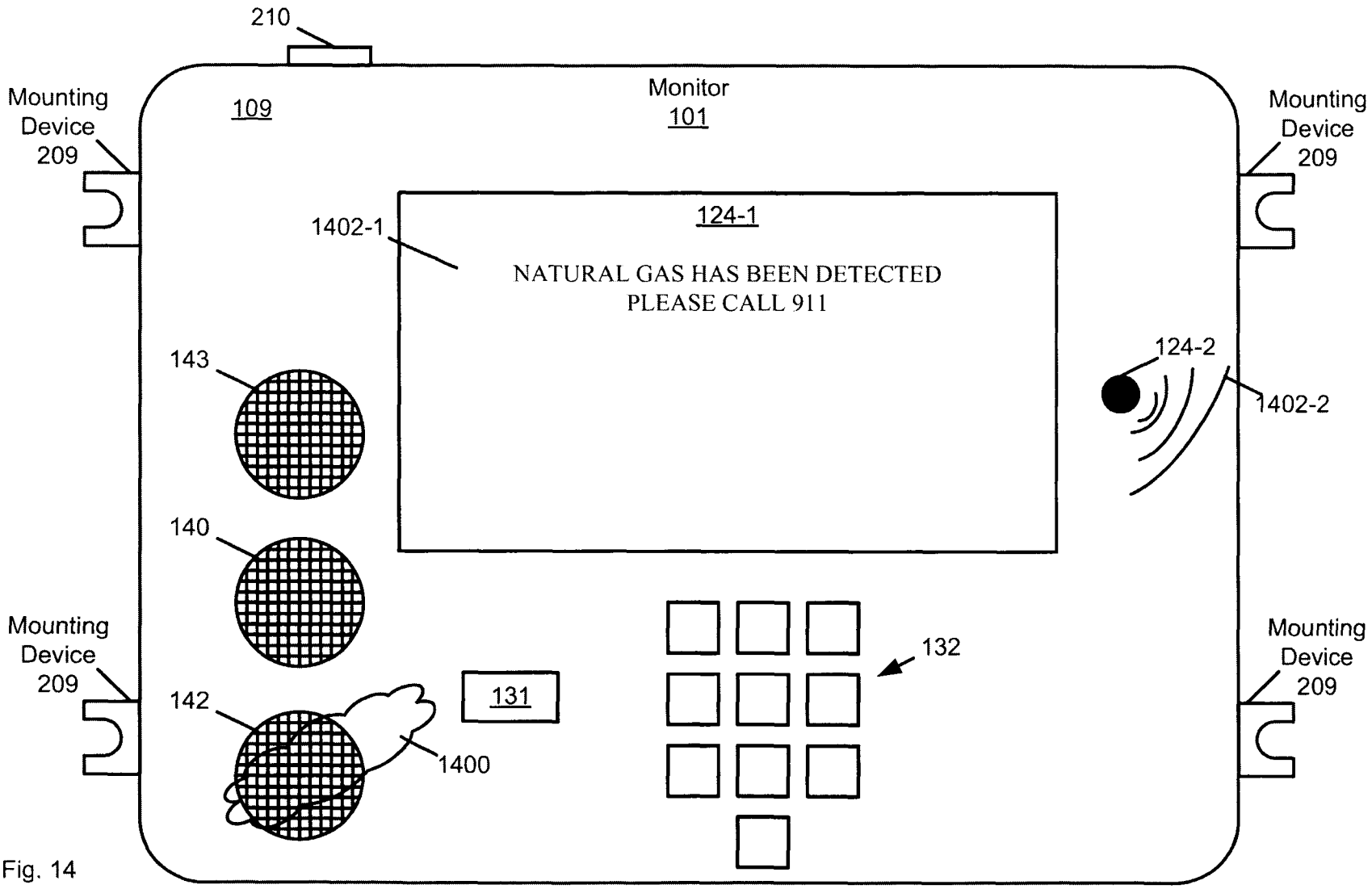
FIG. 14 depicts the monitor detecting natural gas, according to non-limiting implementations.

Attention is next directed to FIG. 14, which is substantially similar to FIG. 2, with like elements having like numbers. FIG. 14 shows natural gas 1400 being detected by the natural gas detector 142, and the monitor 101 providing, at the indicators 124-1, 124-2 a respective alarm 1402-1, 1402-2, to provide a warning that natural gas 1400 has been detected. In some of these implementations, one or more of reset devices 131, 132 can be used to reset alarms 1402-1, 1402-2. For example, first reset device 131 can be used to temporarily reset alarms 1402-1, 1402-2, which alarms 1402-1, 1402-2 can be provided again after a given time period; and second reset device 132 can be used to reset alarms 1402-1, 1402-2 until natural gas is again detected. Similar to implementations described above, resetting alarms 1402-1, 1402-2 using second reset device 132 can occur using a given alphanumeric code that is known to a licensed technician and/or emergency personnel, but not to a homeowner. In alternative implementations, however, alarms 1402-1, 1402-2 cannot be reset using first reset device 131 and/or by a homeowner to encourage the homeowner to call a licensed technician and/or emergency personnel, due to the implicit danger of natural gas.

The above descriptions of the detection of CO and natural gas apply likewise to the detection of radon gas by the radon detector 143.

Figure 15:
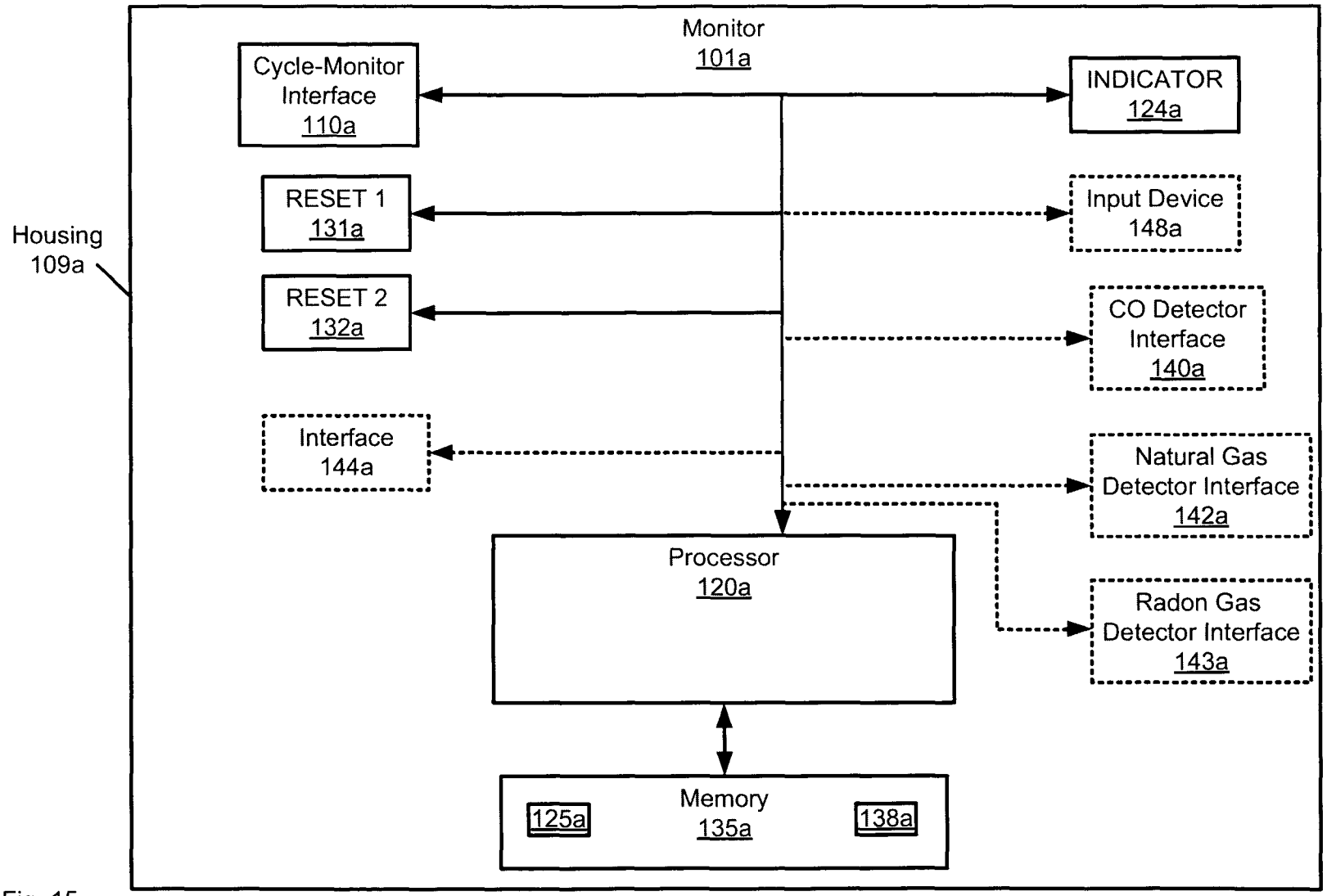
FIG. 15 depicts a schematic block diagram of an alternative monitor for monitoring a natural gas-fired appliance, according to non-limiting implementations.

Attention is next directed to FIG. 15, which depicts an alternative monitor 101*a*, which is substantially similar to monitor 101, with like elements having like numbers, however, with an "a" appended thereto. Hence, monitor 101*a* comprises a housing 109*a*, a processor 120*a* interconnected with a cycle-monitor interface 110*a*, one or more indicators 124*a*, a first reset device 131*a*, a second reset device 132*a*, a memory 135*a* (storing a threshold value 125*a* and an application 138*a*), a communication interface 144*a*, and an input device 148*a*. However, rather than a CO detector, a natural gas detector, and radon gas detector, monitor 101 comprises a CO detector interface 140*a*, a natural gas detector interface 142*a*, and a radon gas detector interface 143*a*. CO detector interface 140*a*, natural gas detector interface 142*a*, and radon gas detector interface 143*a* can connect respectively to an external CO detector, an external natural gas detector, and an external radon gas detector, each mounted within, adjacent or proximal (near) the appliance 301. For example, with reference to FIG. 12, each of an external CO detector, an external natural gas detector, and an external radon gas detector can be mounted on and/or adjacent to chassis 319 and/or in locations similar to cycling detectors 1201. CO detector interface 140*a*, natural gas detector interface 142*a*, and radon gas detector interface 143*a* can respectively receive a CO detection signal, a natural gas detection signal, and a radon gas detector signal from the external CO detector, the external natural gas detector, and the external radon gas detector, when CO, natural and radon gas are respectively detected.

Attention is next directed to FIG. 16 which depicts an alternative implementation of a monitor 101*b*. FIG. 16 is substantially similar to FIG. 2, with like elements having like numbers, however with a "b" appended thereto. Furthermore, while only external components of monitor 101*b* are depicted, it is appreciated that internal components, such as a processor, a cycle-monitor interface, a communication interface and the like are nonetheless present. Depicted external components of monitor 101*b* include a housing 109*b*, an external port and/or external connector 210*b* of an internal cycle-monitor interface, a first indicator 124*b*-1 comprising a display device, a second indicator 124*b*-2 comprising a speaker, first reset device 131*b*, comprising an actuatable button, and a second reset device 132*b* comprising a lock. External components of optional CO detector 140*b*, optional natural gas detector 142*b*, and optional radon gas detector 143*b* are also depicted, as well as mounting devices 209*b*.

Hence, in contrast to monitor 101, as depicted in FIG. 2, second reset device 132*b* comprises a lock, the keyhole for which is depicted in FIG. 16. Second reset device 132*b* can be actuated by an actuation device 1601, i.e. a key, when actuation device 1601 actuates second reset device 132*b* (e.g. the key is inserted into the lock and turned). Actuation device 1601 can be supplied to a licensed technician but not a homeowner, so that the homeowner must call the licensed technician to reset the monitoring, and service the natural gas-fired appliance that is being monitored.

Attention is next directed to FIGS. 17 and 18 which depict an alternative implementation of a monitor 101*c*. FIGS. 17 and 18 are each substantially to FIG. 2, with like elements having like numbers, however with a "c" appended thereto. FIG. 17 depicts monitor 101*e* in a closed configuration while FIG. 18 depicts monitor 101*c* in an open configuration. Further, while only external components of monitor 101*c* are depicted, it is appreciated that internal components, such as a processor, a cycle-monitor interface, a communication interface and the like are nonetheless present. Depicted external components of monitor 101*c* include a housing 109*c*, an external port and/or external connector 210*c* of an internal cycle-monitor interface, a first indicator 124*c*-1 comprising a display device, a second indicator 124*c*-2 comprising a speaker, first reset device 131*c*, comprising an actuatable button, a second reset device 132*c* comprising a respective actuatable button; external components of optional CO detector 140*c*, optional natural gas detector 142*c*, and optional radon gas detector 143*c* are also depicted, as well as mounting devices 209*c*.

Hence, in contrast to monitor 101, as depicted in FIG. 2, second reset device 132*c* is located at an interior of monitor 101*c* such that second reset device 132*c* is accessible only when monitor 101*c* is physically opened using one or more tools associated with a licensed technician. For example, as depicted, housing 109*c* comprises a panel 1701 which is secured using screws 1703 and panel 1701 can only be removed when screws 1703 are removed using a complementary screwdriver 1711 (the tip of which is depicted in FIG. 17); in general screws 1703 and screwdriver 1711 are non-standard, i.e. type which is generally not available for purchase by the general public, but distributed only to licensed technicians so that only a licensed technician can open panel 1701. Hence, while as depicted screws 1703 and screwdriver 1711 are each triangular types, screws 1703 and screwdriver 1711 can be any type which is generally not available for purchase by the general public, but distributed only to licensed technicians.

Second reset device 132*c* is located behind panel 1701, accessible via an aperture 1801 (panel 1701 covering aperture 1801, aperture 1801 and screw-holes 1803 for screws 1703 depicted in FIG. 18); hence once panel is removed, as in FIG. 18, second reset device 132*c* can be actuated (e.g. by receipt of pressure thereupon) though aperture 1801, and monitoring can be reset. Panel 1701 can then reattached to monitor 101*c* to prevent access thereto by a homeowner.

In some implementations, as depicted, only a portion of housing 109*c* is removable, while in other implementations all housing 109*c* can be removable, and/or a front portion and/or a front half of housing is removable to expose and/or access second reset device 132*c*.

Similarly, while screws and a screwdriver can be used to open monitor any mechanism for securing and/or opening housing is within the scope of present implementations, including but not limited to locks, keys, and the like.

Figure 19:
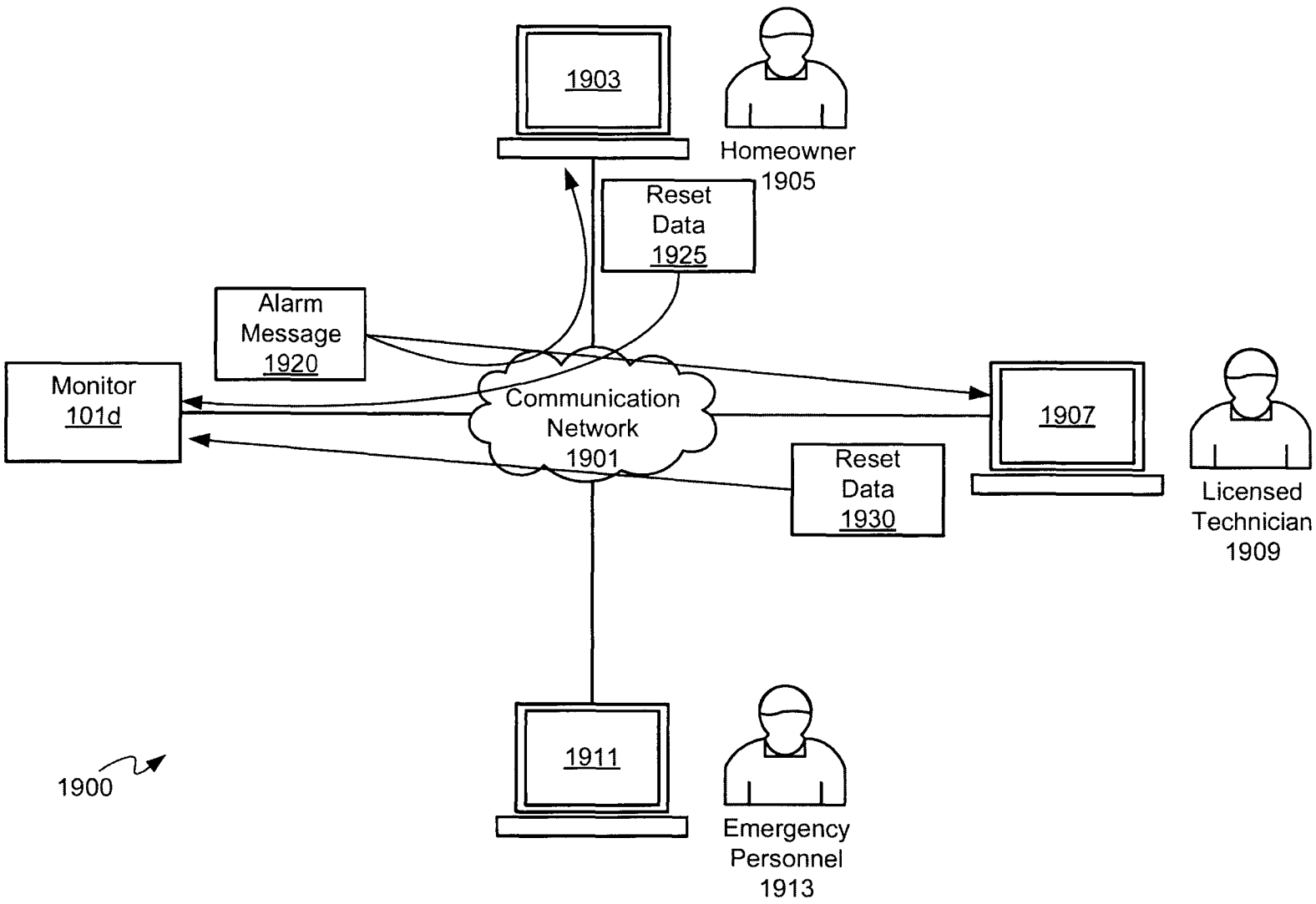
FIG. 19 depicts an alternative system for providing digital alarms from an alternative monitor for monitoring a natural gas-fired appliance, according to non-limiting implementations.

Attention is next directed to FIG. 19 which depicts a system 1900 that includes a monitor 101*d*, a communication network 1901 (interchangeably referred to hereafter as network 1901), a computing device 1903 associated with a homeowner 1905, and the like, and a computing device 1907 associated with a licensed technician 1909, and a computing device 1911 associated with emergency personnel 1913. Computing devices 1903, 1907, 1911 are interchangeably referred to hereafter, respectively, as devices 1903, 1907, 1911. Monitor 101*d*, and devices 1903, 1907, 1911 are each configured to communicate via network 1901, for example using respective communication interfaces similar to interface 144 as described above.

Further, each of devices 1903, 1907, 1911 can include, but are not limited to, any suitable combination of electronic devices, communications devices, computing devices, personal computers, servers, laptop computers, portable electronic devices, mobile computing devices, portable computing devices, tablet computing devices, laptop computing devices, internet-enabled appliances and the like. Other suitable devices are within the scope of present implementations. Hence, in general, each of monitor 101*d*, and devices 1903, 1907, 1911 can exchange messages with each other.

Monitor 101*d* can generally be similar to any of monitors 101*a*, 101*b*, 101*c*, as described above, however, monitor 101*d* is configured to transmit and receive messages with one more of devices 1903, 1907, 1911.

For example, in some implementations, when an alarm occurs at monitor 101*d*, for example due to a cycle-monitoring threshold being met (similar to threshold value 125), can transmit an alarm message 1920 to device 1903 and/or device 1907 either in lieu of and/or in addition to alarms provided at indicators at monitor 101*d*. Indeed, in these implementations, monitor 101*d* may not comprise indicators that provide an audible and/or visual alarm at monitor 101*d*; rather indicators providing an alarm are combined with a communication interface to provide a digital alarm to device 1903 and/or device 1907. Alarm messages 1920 can continue to be resent periodically until a reset device is actuated at monitor 101*d*. However, in these implementations, such a reset device, can be implemented digitally and/or via software, such that homeowner 1905 can temporarily reset the alarm by causing device 1903 to transmit reset data 1925 comprising a rest command, to digitally actuate a reset device at monitor 101*d*. Receipt of reset data 1925 at monitor 101*d* can cause the digital alarm to be temporarily reset, temporarily suspending periodic transmission of alarm messages 1920; however, transmission of alarm messages 1920 can resume after a given time period.

Homeowner 1905 can contact licensed technician 1909 at device 1907 using messaging between devices 1903, 1907, and/or, when device 1907 also receives alarm messages 1920, licensed technician 1905 can contact homeowner 1905 using messaging. Once a service call is arranged, licensed technician 1909 can cause device 1907 to transmit reset data 1930 to monitor 101*d* to reset the monitoring.

Hence, in implementations depicted in FIG. 19, a firs reset device, a second reset device, and an indicator for alarms can all be digital and/or software implemented, with alarms and resetting all occurring via messaging, such as email, text messages, and the like. However, in other implementations digital and/or software implemented alarms and/or indicators can occur in parallel with audible and/or visual alarms at monitor 101*d*.

Similarly, messages associated with detection of CO, natural gas and radon gas can be transmitted by monitor 101*d* to one or more of devices 1903, 1907, 1911 to alert one or more of homeowner 1905, licensed technician 1909 and emergency personnel 1913 of the presence of CO, natural gas, and/or radon gas proximal the natural gas-fired appliance that is being monitored. Such digital alarms can be accompanied by visual and/or audible alarms at the premises where monitor 101*d* is located to provide a warning to people in the proximity of the natural gas-fired appliance.

As such, network addresses of each of devices 1903, 1907, 1911 are pre-populated at a memory of monitor 101*d* to implement the messaging.

Monitor for a natural gas-fired appliance, the monitor comprising a natural gas cycle-monitor interface configured to receive cycling signals from one or more of: the natural gas-fired appliance; and a monitoring device located at least one of in the natural gas-fired appliance and proximal to the natural gas-fired appliance. Hence, monitoring of cycles of the appliance occurs directly at the natural gas-fired appliance for example by monitoring a gas valve signal, in contrast to thermostats which measure cycles by monitoring thermostat signals to a furnace, which is not necessarily indicative of the furnace actually turning on and/or cycling. The monitor provides an alarm when cycles of the appliance meets a threshold value, the alarm being indicative of a need to have the appliance serviced and/or to call a licensed technician. The alarm can be audible and/or visual, but either way provides an alert to a homeowner to have the appliance serviced. Furthermore, the monitor has a first reset device, readily accessible to a homeowner, who can temporarily reset the alarm using the first reset device. The monitor further comprises a second reset device for resetting both the alarm and monitoring of the cycles, the second reset device accessible to a licensed technician and not the homeowner.

Hence, the homeowner is forced to call the licensed technician to come reset the monitoring, otherwise the alarm will continue to provide alerts; the licensed technician can then service the appliance. The monitor can further include a natural gas detector, carbon monoxide, and/or radon gas detector, and/or one or more interfaces for interfacing with an external natural gas detector, an external carbon monoxide detector, and/or an external radon gas detector.

Provided herein is a monitor for a natural gas-fired appliance, the monitor comprising a natural gas cycle-monitor interface configured to receive cycling signals from one or more of: the natural gas-fired appliance; and a monitoring device located at least one of in the natural gas-fired appliance and proximal to the natural gas-fired appliance. Hence, monitoring of cycles of the appliance occurs directly at the natural gas-fired appliance, and/or without an intermediary device monitoring signals to the appliance. The monitor provides an alarm when cycles of the appliance meets a threshold value, the alarm being indicative of a need to have the appliance serviced and/or to call a licensed technician. The alarm can be audible and/or visual and/or digital, but either way provides an alert to a homeowner to have the appliance serviced. Furthermore, the monitor has a first reset device, readily accessible to a homeowner, who can temporarily reset the alarm using the first reset device. The monitor further comprises a second reset device for resetting both the alarm and monitoring of the cycles, the second reset device accessible to a licensed technician and not the homeowner. Hence, the homeowner is forced to call the licensed technician to come reset the monitoring; otherwise the alarm will continue to provide alerts; the licensed technician can then service the appliance. The monitor can further include a natural gas detector, carbon monoxide detector, radon gas detector, and/or one or more interfaces for interfacing with an external natural gas detector, an external carbon monoxide detector, and/or radon gas detector.

Those skilled in the art will appreciate that in some implementations, the functionality of monitors 101, 101*a*, 101*b*, 101*c*, 101*d* can be implemented using pre-programmed hardware or firmware elements (e.g., application specific integrated circuits (ASICs), electrically erasable programmable read-only memories (EEPROMs), etc.), or other related components. In other implementations, the functionality of monitors 101, 101*a*, 101*b*, 101*c*, 101*d* can be achieved using a computing apparatus that has access to a code memory (not shown) which stores computer-readable program code for operation of the computing apparatus. The computer-readable program code could be stored on a computer readable storage medium which is fixed, tangible and readable directly by these components, (e.g., removable diskette, CD-ROM, ROM, fixed disk, USB drive). Furthermore, it is appreciated that the computer-readable program can be stored as a computer program product comprising a computer usable medium. Further, a persistent storage device can comprise the computer readable program code. It is yet further appreciated that the computer-readable program code and/or computer usable medium can comprise a non-transitory computer-readable program code and/or non-transitory computer usable medium. Alternatively, the computer-readable program code could be stored remotely but transmittable to these components via a modem or other interface device connected to a network (including, without limitation, the Internet) over a transmission medium. The transmission medium can be either a non-mobile medium (e.g., optical and/or digital and/or analog communications lines) or a mobile medium (e.g., radio-frequency (RF), microwave, infrared, free-space optical or other transmission schemes) or a combination thereof.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A monitor for a natural gas-fired appliance, the monitor comprising:

a natural gas cycle-monitor interface configured to receive gas-valve actuation signals from one or more of the natural gas-fired appliance and a monitoring device located at least one of in the natural gas-fired appliance and proximal to the natural gas-fired appliance salve of the natural gas-fired appliance;

a gas valve connector to transmit gas valve actuation signals to a controller of a gas valve of the natural gas-fired appliance;

a t-connector installed between the gas valve and the gas valve connector, thet-connector to interface with the gas valve and the gas valve connector to transmit the gas valve actuation signals to the natural gas cycle-monitor interface without altering transmission of the gas valve actuation signals from the gas valve connector to the controller of the gas valve;

a processor, in communication with the natural gas cycle-monitor interface, the processor configured to monitor cycles of the natural gas-fired appliance based on the gas-valve actuation signals;

one or more indicators, in communication with the processor, the one or more indicators configured to provide an alarm when the processor determines that the cycles of the natural gas-fired appliance meets a threshold value;

a first reset device configured to temporarily reset the one or more indicators to turn off the alarm when actuated, wherein the first reset device is located at an exterior of the monitor, the one or more indicators again providing the alarm after a given time period has elapsed following a temporary reset; and, a second reset device configured to reset monitoring of the cycles at the processor when actuated, wherein the second reset device is located at an interior of the monitor such that the second reset device is accessible only when the monitor is physically opened, and wherein the second reset device is further configured to reset the one or more indicators to turn off the alarm until the cycles again reach the threshold value;

wherein the monitor is configured to:

transmit an alarm message to a remote device when the processor determines that the cycles of the natural gas-fired appliance meets the threshold value;

receive reset data from the remote device to:

temporarily reset the one or more indicators to turn off the alarm when actuated, the one or more indicators again providing the alarm after a given time period following a temporary reset; or reset monitoring of the cycles at the processor and to reset the one or more indicators to turn off the alarm until the cycles again reach the threshold value; and wherein the monitor is configured for opening only by a key or tool.

2. The monitor of claim 1, wherein the first reset device is configured to be actuated upon receipt of pressure thereupon.

3. The monitor of claim 1, wherein the first reset device is configured to be actuated by receipt of a first code available to a first user, and wherein the second reset device is configured to be actuated by receipt of a second code available to a second user, the second code not available to the first user.

4. The monitor of claim 1, further comprising: one or more mounting devices configured to mount the monitor one or more of: on the natural gas-fired appliance; and proximal to the natural gas-fired appliance.

5. The monitor of claim 1, further comprising one or more of:

a CO detector in communication with the processor;

a CO detector interface configured for communication with an external CO detector, the CO detector interface in communication with the processor;

a natural gas detector in communication with the processor;

a natural gas detector interface configured for communication with an external natural gas detector, the natural gas detector interface in communication with the processor;

a radon gas detector in communication with the processor; and a radon gas detector interface configured for communication with an external radon gas detector, the radon gas detector interface in communication with the processor;

the one or more indicators further configured to provide a respective alarm when the processor determines that one or more of: the CO detector has detected CO, the CO detector interface receives a CO detection signal, the natural gas detector has detected natural gas, the natural gas detector interface receives a natural gas detection signal, the radon gas detector has detected radon gas, and the radon gas detector interface receives a radon gas detection signal.

6. An appliance comprising:

a natural gas-fired appliance; and, a monitor, the monitor mounted to the natural gas-fired appliance, the monitor comprising:

a natural gas cycle-monitor interface configured to receive gas-valve actuation signals from one or more of the natural gas-fired appliance and a monitoring device located at least one of in the natural gas-fired appliance and proximal to the natural gas-fired appliance;

a gas valve connector to transmit gas valve actuation signals to a controller of a gas valve of the natural gas-fired appliance;

a t-connector installed between the gas valve and the gas valve connector, the t-connector to interface with the gas valve and the gas valve actuation signals to the natural gas cycle-monitor interface without altering transmission of the gas valve actuation signals from the gas valve connector to the controller of the gas valve;

a processor, in communication with the natural gas cycle-monitor interface, the processor configured to monitor cycles of the natural gas-fired appliance based on the gas-valve actuation signals;

one or more indicators, in communication with the processor, the one or more indicators configured to provide an alarm when the processor determines that the cycles of the natural gas-fired appliance meets a threshold value;

a first reset device configured to temporarily reset the one or more indicators to turn off the alarm when actuated, wherein the first reset device is located at an exterior of the monitor, the one or more indicators again providing the alarm after a given time period has elapsed following a temporary reset; and, a second reset device configured to reset monitoring of the cycles at the processor when actuated, wherein the second reset device is located at an interior of the monitor such that the second reset device is accessible only when the monitor is physically opened, and wherein the second reset device is further configured to reset the one or more indicators to turn off the alarm until the cycles again reach the threshold value;

wherein the monitor is configured to:

transmit an alarm message to a remote device when the processor determines that the cycles of the natural gas-fired appliance meets the threshold value;

receive reset data from the remote device to:

temporarily reset the one or more indicators to turn off the alarm when actuated, the one or more indicators again providing the alarm after a given time period following a temporary reset; or reset monitoring of the cycles at the processor and to reset the one or more indicators to turn off the alarm until the cycles again reach the threshold value; and wherein the monitor is configured for opening only by a key or tool.

7. The appliance of claim 6, wherein the first reset device is configured to be actuated upon receipt of pressure thereupon.

8. The appliance of claim 6, wherein the first reset device is configured to be actuated by receipt of a first code available to a first user, and wherein the second reset device is configured to be actuated by receipt of a second code available to a second user, the second code not available to the first user.

9. The appliance of claim 6, wherein the monitor further comprises one or more of:

a CO detector in communication with the processor;

a CO detector interface configured for communication with an external CO detector, the CO detector interface in communication with the processor;

a natural gas detector in communication with the processor; and, a natural gas detector interface configured for communication with an external natural gas detector, the natural gas detector interface in communication with the processor, a radon gas detector in communication with the processor;

a radon gas detector interface configured for communication with an external radon gas detector, the radon gas detector interface in communication with the processor;

the one or more indicators further configured to provide a respective alarm when the processor determines that one or more of: the CO detector has detected CO, the CO detector interface receives a CO detection signal, the natural gas detector has detected natural gas, and the natural gas detector interface receives a natural gas detection signal, the radon gas detector has detected radon gas, and the radon gas detector interface receives a radon gas detection signal.

* * * * *